US011398686B2

(12) United States Patent
Kameda et al.

(10) Patent No.: US 11,398,686 B2
(45) Date of Patent: Jul. 26, 2022

(54) WIRE, WIRE WITH TERMINAL, HARNESS, MANUFACTURING METHOD FOR WIRE, AND MANUFACTURING METHOD FOR WIRE WITH TERMINAL

(71) Applicant: Japan Aviation Electronics Industry, Ltd., Tokyo (JP)

(72) Inventors: Kenji Kameda, Shibuya-ku (JP); Kazuomi Sato, Shibuya-ku (JP); Kenji Yamazaki, Shibuya-ku (JP); Hayato Nakamura, Shibuya-ku (JP); Takaichi Teramoto, Shibuya-ku (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 135 days.

(21) Appl. No.: 16/965,108

(22) PCT Filed: Feb. 19, 2019

(86) PCT No.: PCT/JP2019/006011
§ 371 (c)(1),
(2) Date: Jul. 27, 2020

(87) PCT Pub. No.: WO2019/167714
PCT Pub. Date: Aug. 6, 2019

(65) Prior Publication Data

US 2021/0036440 A1 Feb. 4, 2021

(30) Foreign Application Priority Data

Mar. 2, 2018 (JP) ..... JP2018-037952

(51) Int. Cl.
*H01R 4/18* (2006.01)
*H01R 43/05* (2006.01)
*H01R 43/052* (2006.01)

(52) U.S. Cl.
CPC ..... *H01R 4/185* (2013.01); *H01R 43/05* (2013.01); *H01R 43/052* (2013.01)

(58) Field of Classification Search
CPC ..... H01R 4/195; H01R 43/05; H01R 43/052
(Continued)

(56) References Cited

U.S. PATENT DOCUMENTS 7,954,235 B2 * 6/2011 Martauz ..... H01R 4/184 29/857
8,181,343 B2 * 5/2012 Martauz ..... H01R 4/185 29/857

(Continued)

FOREIGN PATENT DOCUMENTS

CN 107123866 A * 9/2017 ..... B23K 1/0008
DE 112011102236 T5 * 4/2013 ..... H01R 4/70

(Continued)

OTHER PUBLICATIONS

Japanese Office Action dated Jul. 13, 2021, in connection with corresponding JP Application No. 2020-503419 (10 pp., including machine-generated English translation).

(Continued)

*Primary Examiner* — Peter G Leigh
(74) *Attorney, Agent, or Firm* — Maier & Maier, PLLC

(57) ABSTRACT

A wire includes a core wire and an insulation coating that covers an outer periphery of the core wire. The core wire includes a distal end region containing a distal end surface of the core wire, and a body region being a part other than the distal end region. The distal end region includes a first distal end region containing the distal end surface, and a second distal end region located between the first distal end region and the body region. The insulation coating includes a distal end coating part that covers an outer periphery of the first distal end region in a tube shape, an insulation coating (Continued)

body that covers an outer periphery of the body region in a tube shape, a coating joint part that joins the distal end coating part and the insulation coating body together.

19 Claims, 32 Drawing Sheets

(58) Field of Classification Search
USPC ..... 439/877
See application file for complete search history.

(56) References Cited

U.S. PATENT DOCUMENTS

| | | | | |
|---|---|---|---|---|
| 9,065,261 | B2 * | 6/2015 | Kawamura | H02G 1/00 |
| 9,825,450 | B2 * | 11/2017 | Farole | H01R 4/185 |
| 2014/0235117 | A1 | 8/2014 | Sato | |
| 2017/0025769 | A1 * | 1/2017 | Tokunaga | H01R 43/048 |
| 2017/0317430 | A1 * | 11/2017 | Kawamura | H01R 4/185 |
| 2018/0062276 | A1 * | 3/2018 | Hamada | H01R 4/185 |

FOREIGN PATENT DOCUMENTS

| | | | | |
|---|---|---|---|---|
| EP | 2828933 | B1 * | 5/2016 | H01R 4/185 |
| JP | 2008235130 | A * | 10/2008 | |
| JP | 2009-230998 | A | 10/2009 | |
| JP | 2010-061906 | A | 3/2010 | |
| JP | 2011-198514 | A | 10/2011 | |
| JP | 2011198514 | A * | 10/2011 | H01R 4/20 |
| JP | 2013-105583 | A | 5/2013 | |
| JP | 2014-160595 | A | 9/2014 | |
| JP | 2015-115308 | A | 6/2015 | |
| WO | WO-2011122302 | A1 * | 10/2011 | H01R 4/20 |
| WO | WO-2012043793 | A1 * | 4/2012 | H01R 4/18 |
| WO | WO-2013069817 | A1 * | 5/2013 | H01R 4/18 |
| WO | 2013/142666 | A1 | 9/2013 | |

OTHER PUBLICATIONS

International Search Report dated Apr. 2, 2019 in corresponding International Application No. PCT/JP2019/006011; 4 pages.
European Search Report dated Feb. 18, 2021, in connection with corresponding EP Application No. 19760556.1; 4 pages.
European Office Action dated Mar. 16, 2021, in connection with corresponding EP Application No. 19760556.1; 9 pages.

* cited by examiner

WIRE, WIRE WITH TERMINAL, HARNESS, MANUFACTURING METHOD FOR WIRE, AND MANUFACTURING METHOD FOR WIRE WITH TERMINAL

FIELD

The present invention relates to a wire, a wire with terminal, a harness, a manufacturing method for a wire, and a manufacturing method for a wire with a terminal.

BACKGROUND

Japanese Unexamined Patent Application Publication No. 2015-115308 discloses an aluminum wire 102 composed of a core wire 100 and an insulation coating 101 as shown in FIG. 32 of the present application. The insulation coating 101 has a partially peeled part 103 so that the core wire 100 is exposed. A terminal 104 has a rib 106 with a rectangular frame shape along the periphery of a swaging part 105, and the rib 106 bites into the insulation coating 101, and thereby the partially peeled part 103 is sealed.

SUMMARY

However, Japanese Unexamined Patent Application Publication No. 2015-115308 mentions nothing about sealing a distal end surface of the core wire.

An object of the present invention is to provide a technique to reliably seal a distal end surface of a core wire as well as preventing a distal end coating part that covers a distal end of the core wire from coming off.

According to a first aspect of the present invention, there is provided a wire including a core wire and an insulation coating that covers an outer periphery of the core wire, wherein the core wire includes a distal end region containing a distal end surface of the core wire, and a body region being a part other than the distal end region, the distal end region includes a first distal end region containing the distal end surface, and a second distal end region located between the first distal end region and the body region, and the insulation coating includes a distal end coating part that covers an outer periphery of the first distal end region in a tube shape, an insulation coating body that covers an outer periphery of the body region in a tube shape, at least one coating joint part that joins the distal end coating part and the insulation coating body together in such a way that at least part of an outer periphery of the second distal end region is exposed, and a coating extension part that extends from the distal end coating part beyond the distal end surface in a tube shape.

A thickness of the coating joint part in a radical direction is preferably smaller than a maximum thickness of the insulation coating body in the radial direction.

Preferably, the insulation coating body includes a first body part touching the coating joint part, and a second body part located farther from the distal end surface than the first body part is, a thickness of the first body part in the radial direction is the same as the thickness of the coating joint part in the radial direction, and a thickness of the second body part in the radial direction is greater than the thickness of the first body part in the radial direction.

Preferably, a welded part having been crushed in a cross direction crossing a longitudinal direction of the wire and closed by welding is formed in the coating extension part.

When viewing in the longitudinal direction of the wire, a center of gravity of a cross-section of the welded part orthogonal to the longitudinal direction of the wire and a center of gravity of a cross-section of the distal end coating part orthogonal to the longitudinal direction of the wire preferably do not coincide.

The welded part is preferably formed to avoid a virtual extension line of a central axis of the core wire.

A cross-sectional shape of the welded part orthogonal to the longitudinal direction of the wire is preferably a track shape, an ellipse, a U-shape, or a V-shape.

The cross direction is preferably a direction orthogonal to the longitudinal direction of the wire.

Preferably, an internal space of the coating extension part is filled with a sealing material, or a sealing member is inserted into the internal space of the coating extension part.

Preferably, there is provided a wire with a terminal including the above-described wire, and a terminal attached to the wire, wherein the terminal includes an electrical contact part capable of coming into electrical contact with a mating terminal, a wire crimp part to be crimped onto the wire, and a terminal joint part that joins the electrical contact part and the wire crimp part together, and the wire crimp part includes two crimp pieces, and each of the crimp pieces is crimped onto the distal end coating part, the second distal end region, and the insulation coating body, and thereby the second distal end region is sealed, or the wire crimp part is formed in a tube shape and crimped onto the distal end coating part, the second distal end region, and the insulation coating body, and thereby the second distal end region is sealed.

When viewing the wire crimp part from the electrical contact part in the longitudinal direction of the wire, a center of gravity of a cross-section of the welded part orthogonal to the longitudinal direction of the wire is preferably located between a center of gravity of a cross-section of the distal end coating part orthogonal to the longitudinal direction of the wire and the terminal joint part.

Preferably, there is provided a harness including the above-described wire, and a housing that accommodates the wire with the terminal.

Preferably, there is provided a wire with a terminal including the above-described wire, and a terminal attached to the wire, wherein the terminal includes an electrical contact part capable of coming into electrical contact with a mating terminal, a wire crimp part to be crimped onto the wire, and a terminal joint part that joins the electrical contact part and the wire crimp part together, and the wire crimp part includes two crimp pieces, and each of the crimp pieces is crimped onto the distal end coating part, the second distal end region, and the insulation coating body, and thereby the second distal end region is sealed, or the wire crimp part is formed in a tube shape and crimped onto the distal end coating part, the second distal end region, and the insulation coating body, and thereby the second distal end region is sealed.

Preferably, there is provided a harness including the above-described wire, and a housing that accommodates the wire with terminal.

According to a second aspect of the present invention, there is provided a manufacturing method for a wire, including an exposing step of exposing at least part of a core wire by making a hole in an insulation coating that covers the core wire, and a stretching step of stretching the insulation coating in such a way that the insulation coating extends beyond a distal end surface of the core wire.

Preferably, the stretching step is performed after the exposing step, and in the stretching step, the insulation coating is stretched in such a way that the hole made in the exposing step is enlarged.

Preferably, the exposing step is performed after the stretching step, and in the exposing step, the hole is made in a part having become thinner than before stretching as a result of having been stretched in the stretching step.

The manufacturing method preferably further includes a slit cutting step of cutting, in the insulation coating, at least two first slits extending in the longitudinal direction of the core wire and separating from each other in a circumferential direction, wherein the stretching step is performed after the slit cutting step, the exposing step is performed after the stretching step, in the stretching step, the insulation coating is stretched in such a way that the at least two first slits cut in the slit cutting step are elongated, and in the exposing step, at least two second slits are cut to connect corresponding ends of the at least two first slits, and thereby the hole is made in the insulation coating.

The manufacturing method preferably further includes a step of crushing a part of the insulation coating extending beyond the distal end surface of the core wire in a cross direction crossing a longitudinal direction of the core wire, and a step of closing the crushed part by welding.

The manufacturing method preferably further includes a step of filling a sealing material or inserting a sealing member into an internal space of a part of the insulation coating extending beyond the distal end surface of the core wire.

According to a third aspect of the present invention, there is provided a manufacturing method for a wire with a terminal, the method manufacturing the wire with the terminal by attaching the terminal to the wire including a core wire and an insulation coating that covers the core wire, including an exposing step of exposing at least part of the core wire by making a hole in the insulation coating, a stretching step of stretching the insulation coating in such a way that the insulation coating extends beyond a distal end surface of the core wire, a crimping step of crimping a crimp piece of the terminal onto the wire so as to seal a part where the core wire is exposed, and a sealing step of sealing the distal end surface of the core wire by welding a part of the insulation coating extending beyond the distal end surface of the core wire after the crimping step.

According to the present invention, it is able to effectively seal the distal end surface by using the coating extension part as well as preventing the distal end coating part from coming off the core wire.

DETAILED DESCRIPTION OF EMBODIMENTS

First Embodiment

A first embodiment is described hereinafter with reference to FIGS. 1 to 21.

Figure 1:
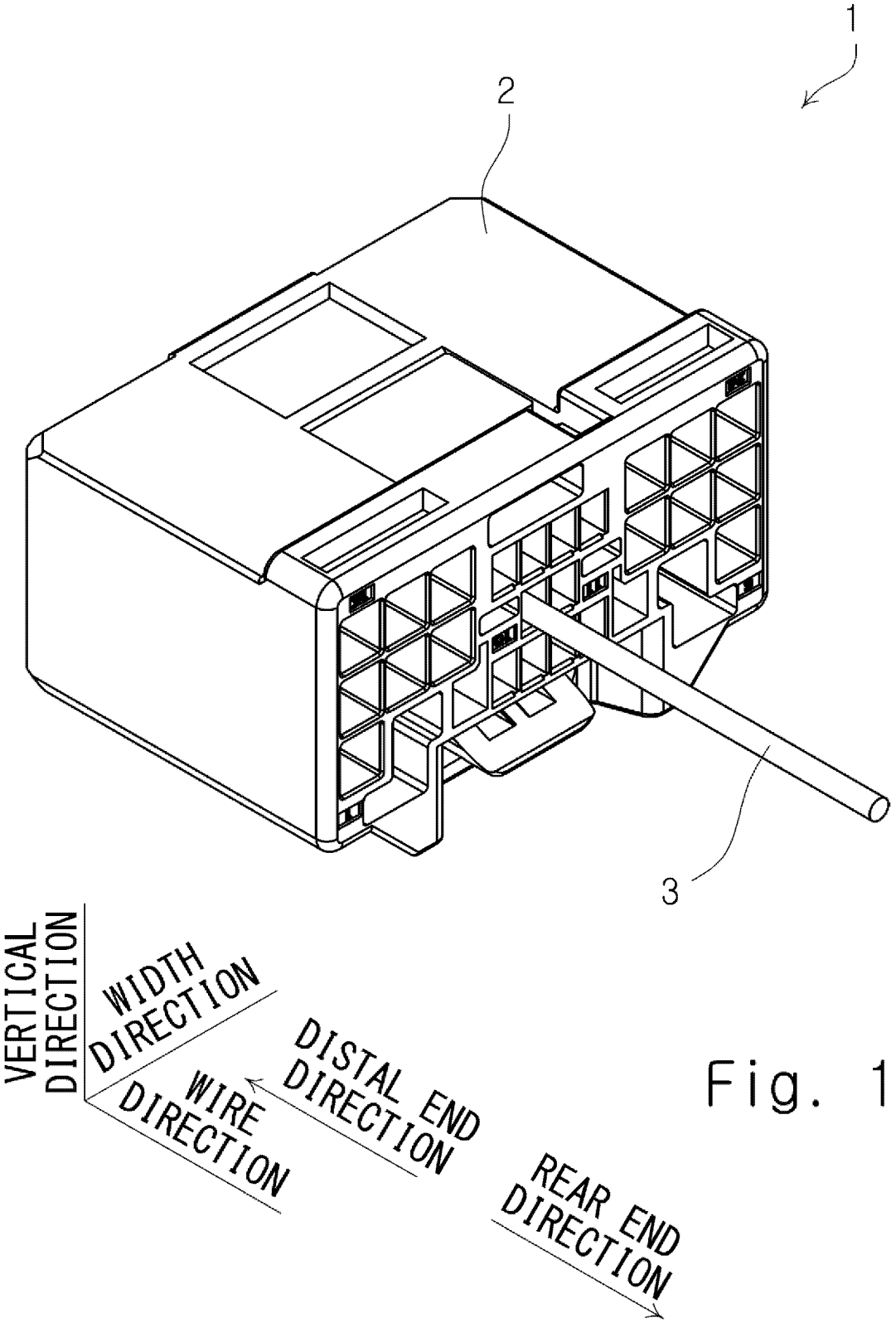
FIG. 1 is a perspective view of a harness (first embodiment).

FIG. 1 is a perspective view of a harness 1. As shown in FIG. 1, the harness 1 includes a housing 2 made of insulating resin and a plurality of wires with terminal 3 to be accommodated in the housing 2. In FIG. 1, only one wire with terminal 3 among the plurality of wires with terminal 3 is shown, and the other wires with terminal 3 are not shown.

Figure 2:
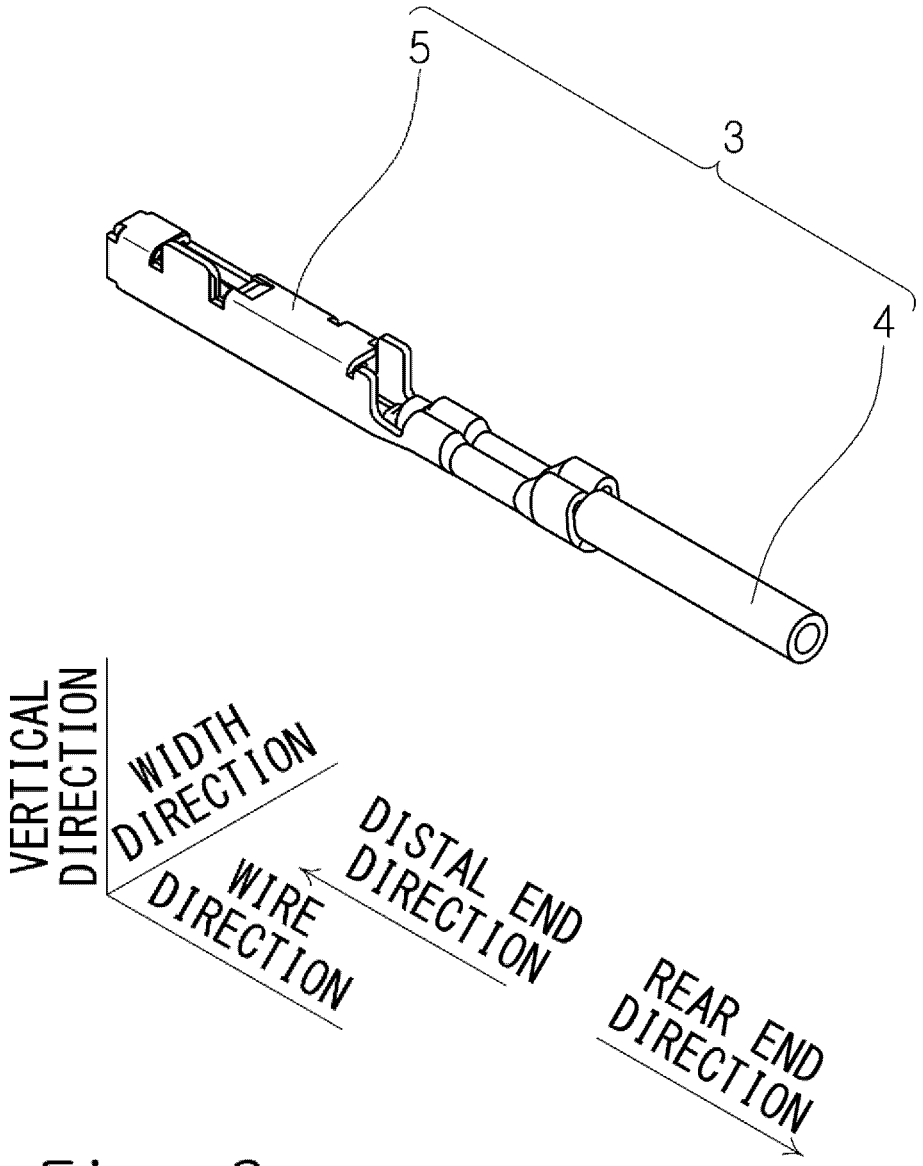
FIG. 2 is a perspective view of a wire with a terminal (first embodiment).

FIG. 2 is a perspective view of the wire with terminal 3. As shown in FIG. 2, the wire with terminal 3 includes a wire 4 and a terminal 5 that is attached to the wire 4.

<Wire 4>

Figure 3:
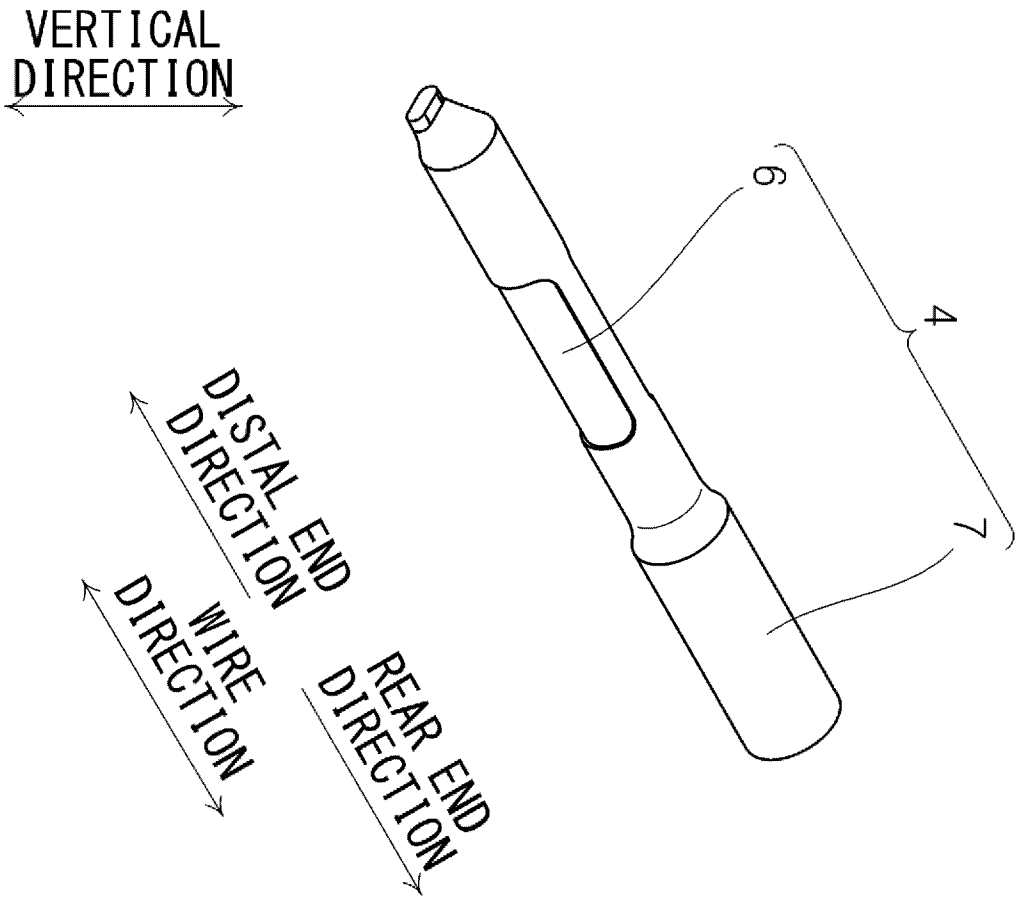
FIG. 3 is a perspective view of a wire before a terminal is attached (first embodiment).
Figure 4:
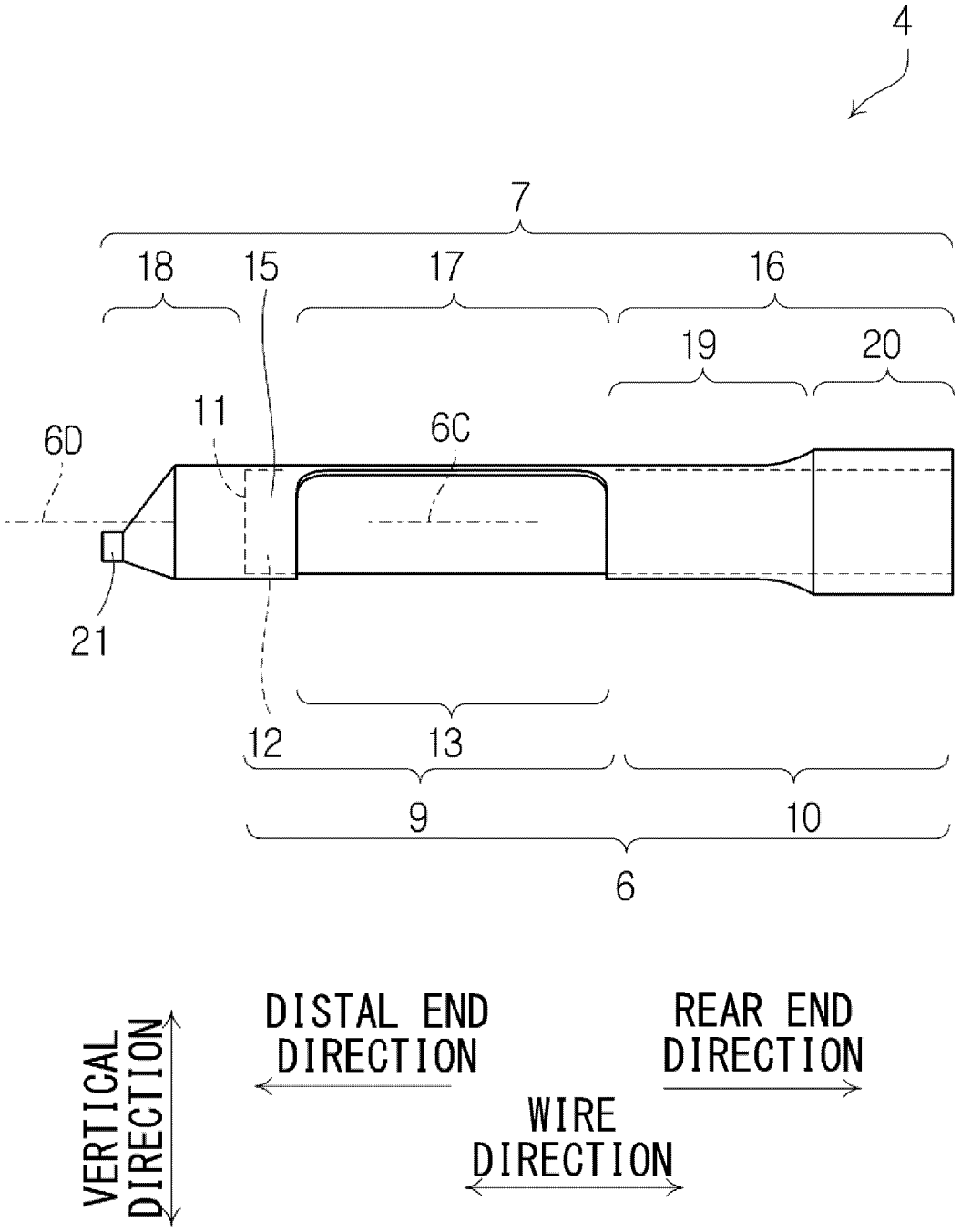
FIG. 4 is a front view of the wire before the terminal is attached thereto (first embodiment).
Figure 5:
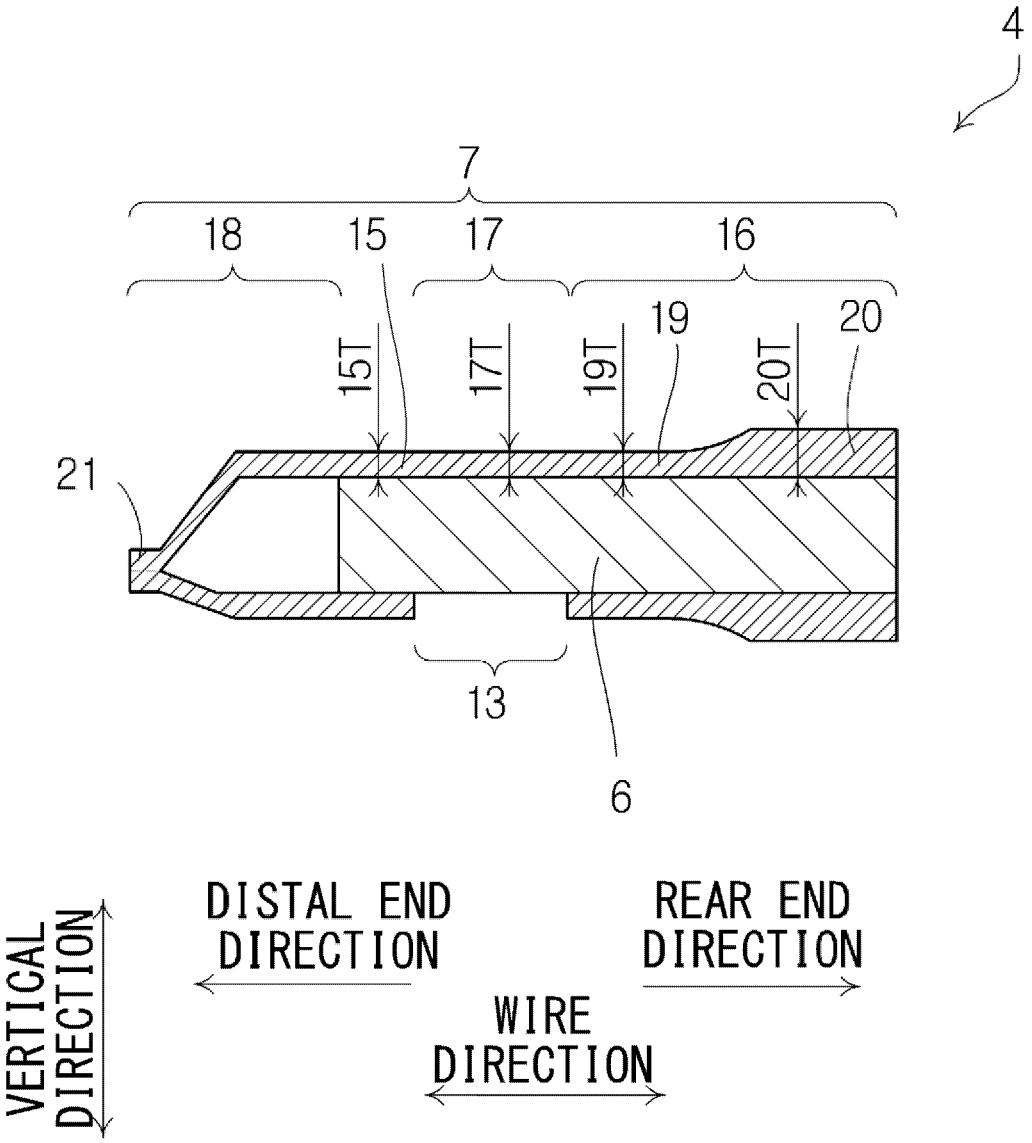
FIG. 5 is a front cross-sectional view of the wire before the terminal is attached thereto (first embodiment).
Figure 6:
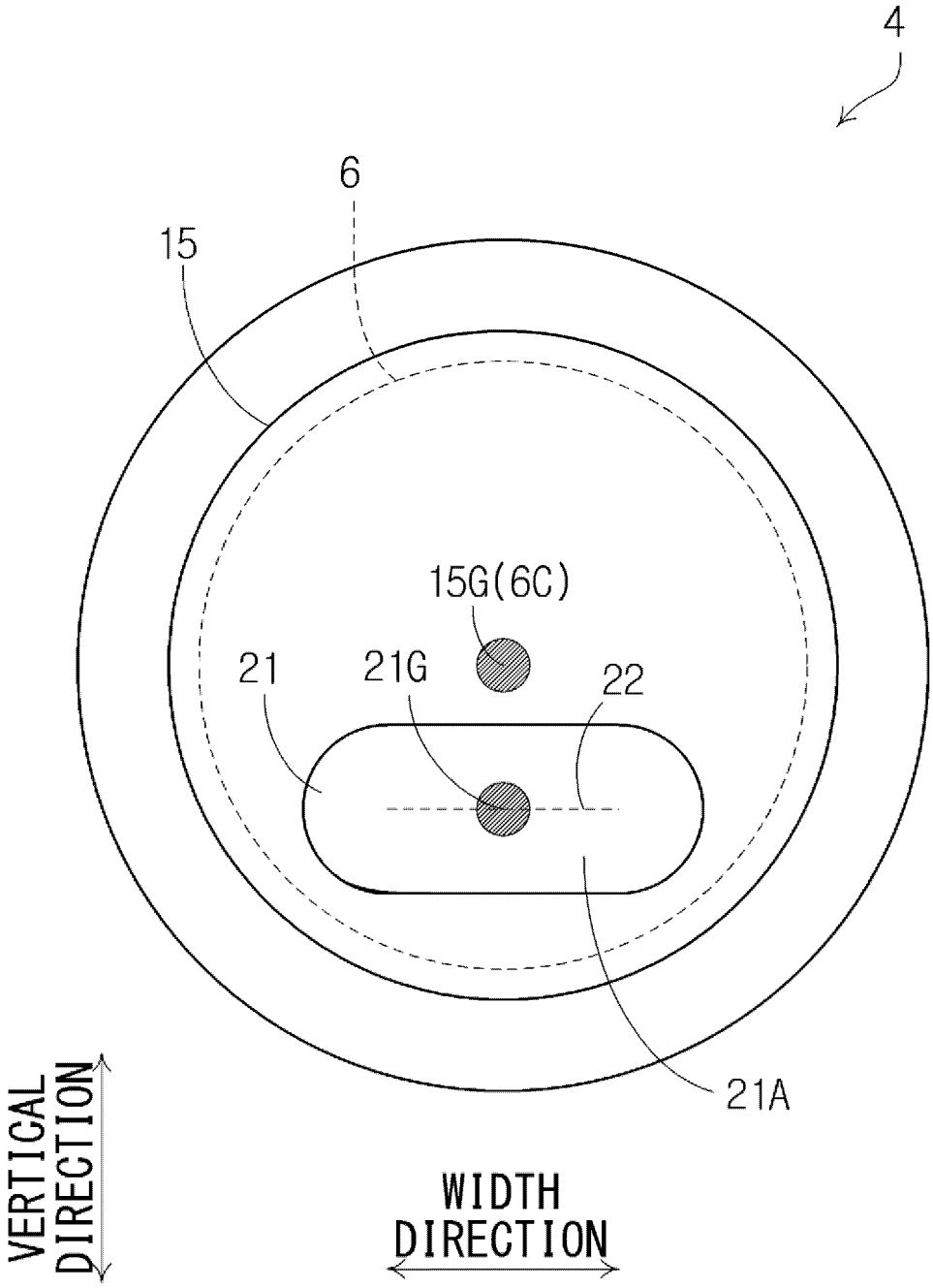
FIG. 6 is a left side view of the wire before the terminal is attached thereto (first embodiment).

FIG. 3 is a perspective view of the wire 4 before the terminal 5 is attached thereto. FIG. 4 is a front view of the wire 4 before the terminal 5 is attached thereto. FIG. 5 is a front cross-sectional view of the wire 4 before the terminal 5 is attached thereto. In FIG. 5, the scale is adjusted for dimensional notation. FIG. 6 is a left side view of the wire 4 before the terminal 5 is attached thereto. As shown in FIGS. 3 and 4, the wire 4 includes a core wire 6 and an insulation coating 7 that covers the outer periphery of the core wire 6.

The core wire 6 is a stranded wire consisting of a plurality of individual wires twisted together, or an aluminum conductor steel-reinforced cable consisting of hard-drawn aluminum wires twisted together around a galvanized steel wire. The material of the individual wires of the stranded wire may be copper, aluminum, or an aluminum alloy, for example. The individual wires of the stranded wire may be plated individually. In this embodiment, the core wire 6 is a stranded wire consisting of a plurality of individual wires made of an aluminum alloy twisted together.

As shown in FIG. 4, the core wire 6 includes a distal end region 9 and a body region 10. The distal end region 9 is a part including a distal end surface 11 of the core wire 6. The body region 10 is a part other than the distal end region 9 of the core wire 6. The distal end region 9 and the body region 10 are adjacent to each other in the longitudinal direction of the wire 4. Hereinafter, the "longitudinal direction of the wire 4" is also referred to simply as "wire direction". The distal end region 9 and the body region 10 are located in this recited order in the direction of drawing away from the distal end surface 11. The distal end region 9 is located between the distal end surface 11 and the body region 10 in the wire direction. The distal end region 9 includes a first distal end region 12 and a second distal end region 13. The first distal end region 12 is a part including the distal end surface 11 of the core wire 6. The second distal end region 13 is a part other than the first distal end region 12 of the distal end region 9. The first distal end region 12 and the second distal end region 13 are adjacent to each other in the wire direction. The first distal end region 12 and the second distal end region 13 are located in this recited order in the direction of drawing away from the distal end surface 11. The second distal end region 13 is located between the first distal end region 12 and the body region 10.

The insulation coating 7 is weldable synthetic resin such as vinyl chloride, for example. "Welding" includes heat welding, ultrasonic welding, and laser welding, for example.

The insulation coating 7 includes a distal end coating part 15, an insulation coating body 16, a coating joint part 17, and a coating extension part 18. The coating extension part 18, the distal end coating part 15, the coating joint part 17 and the insulation coating body 16 are located in this recited order in the wire direction.

The distal end coating part 15 is formed in a tube shape and covers the outer periphery of the first distal end region 12. As shown in FIG. 5, the distal end coating part 15 has a thickness 15T in the radial direction.

Referring back to FIG. 4, the insulation coating body 16 is formed in a tube shape and covers the outer periphery of the body region 10. The insulation coating body 16 includes a first body part 19 and a second body part 20. The first body part 19 and the second body part 20 are adjacent to each other in the wire direction. The first body part 19 is located closer to the distal end surface 11 than the second body part 20 is. The second body part 20 is located farther from the distal end surface 11 than the first body part 19 is. The first body part 19 touches the coating joint part 17 in the wire direction. As shown in FIG. 5, the first body part 19 has a thickness 19T in the radial direction. The second body part 20 has a thickness 20T in the radial direction. The thickness 20T is greater than the thickness 19T. The thickness 20T corresponds to the maximum thickness of the insulation coating body 16.

Referring back to FIG. 4, the coating joint part 17 is a part that joins the distal end coating part 15 and the insulation coating body 16 together. The coating joint part 17 is elongated in the wire direction in such a way that at least part of the outer periphery of the second distal end region 13 is exposed. The central angle of the coating joint part 17 is 5 to 60 degrees, preferably 10 to 45 degrees, and more preferably 15 to 30 degrees. As the central angle of the coating joint part 17 is greater, the sealing effect of the coating joint part 17 increases, and as the central angle of the coating joint part 17 is smaller, the contact reliability between the terminal 5 and the core wire 6 increases. In this embodiment, the distal end coating part 15 and the insulation coating body 16 are joined by one coating joint part 17. However, the distal end coating part 15 and the insulation coating body 16 may be joined by a plurality of coating joint parts 17. As shown in FIG. 5, the coating joint part 17 has a thickness 17T in the radial direction. The thickness 17T is smaller than the thickness 20T which corresponds to the maximum thickness of the insulation coating body 16 in the radial direction. The thickness 15T, the thickness 17T and the thickness 19T are equal.

Referring back to FIG. 4, the coating extension part 18 is a part that extends from the distal end coating part 15 beyond the distal end surface 11 in a tube shape. The coating extension part 18 is a part that does not cover the core wire 6. The coating extension part 18 is a part that projects in a distal end direction from the distal end coating part 15. In one specific example, the projecting length of the coating extension part 18 in the wire direction is greater than the outer diameter of the core wire 6. The "distal end direction" is the direction of viewing the distal end surface 11 from the body region 10 in the wire direction. On the other hand, a "rear end direction" is the direction of viewing the body region 10 from the distal end surface 11 in the wire direction.

In this embodiment, a welded part 21 is formed in the coating extension part 18. The welded part 21 is a tube that is crushed in a vertical direction orthogonal to the wire direction, and it is a part where the internal space of the tube-shaped coating extension part 18 is closed by welding. The welded part 21 extends linearly in the wire direction. As shown in FIG. 6, when viewing the wire 4 in the rear end direction, the cross-sectional shape of the welded part 21 orthogonal to the wire direction is a track shape that is asymmetric with respect to a central axis 6C of the core wire 6 and symmetric in a width direction. In this case, the position of the welded part 21 in a circumferential direction is easily recognizable based on the position of the coating joint part 17 in the circumferential direction. The "width direction" is the direction orthogonal to the vertical direction and the wire direction. The "circumferential direction" is the circumferential direction with respect to the central axis 6C of the core wire 6. FIG. 6 shows a center of gravity 21G of the cross-section of the welded part 21 and a center of gravity 15G of the cross-section of the distal end coating part 15 orthogonal to the wire direction. As shown in FIG. 6, when viewing in the rear end direction, the center of gravity 21G of the cross-section of the welded part 21 and the center of gravity 15G of the cross-section of the distal end coating part 15 do not coincide. As shown in FIG. 4, the welded part 21 is formed to avoid a virtual extension line 6D of the central axis 6C of the core wire 6. As shown in FIG. 6, a linear weld scar 22 is left on a distal end surface 21A of the welded part 21. The weld scar 22 is left as a result of closing the internal space of the tube-shaped coating extension part 18 by welding, and therefore the weld scar 22 extends in a single linear line.

Hereinafter, as shown in FIGS. 1 and 2, the "wire direction, "distal end direction", "rear end direction", "vertical direction" and "width direction" defined in the description of the wire 4 are used in the same manner also in the description of the housing 2 and the terminal 5.

<Terminal 5>

Figure 7:
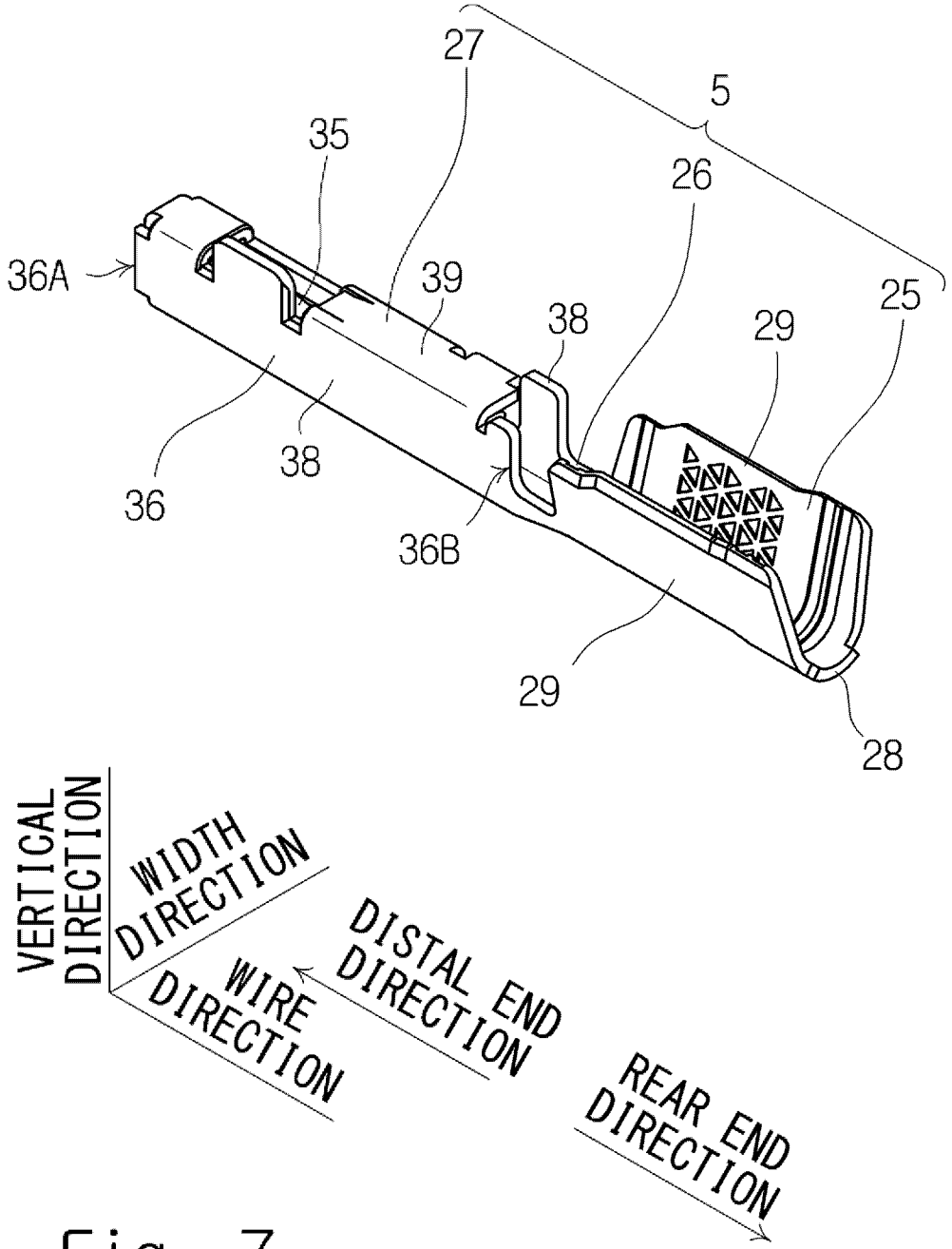
FIG. 7 is a perspective view of the terminal before being attached to the wire (first embodiment).
Figure 8:
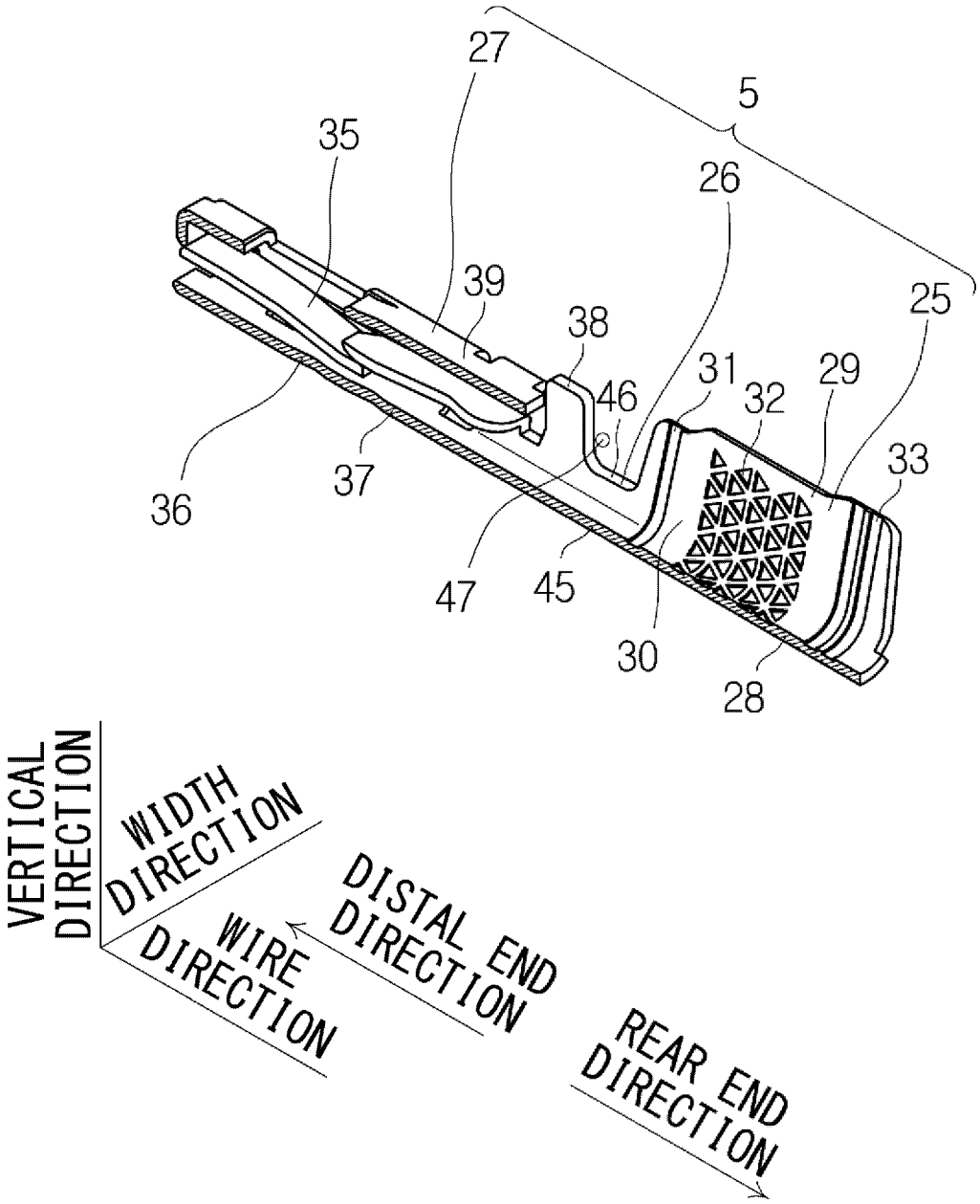
FIG. 8 is a partially cutaway perspective view of the terminal before being attached to the wire (first embodiment).
Figure 9:
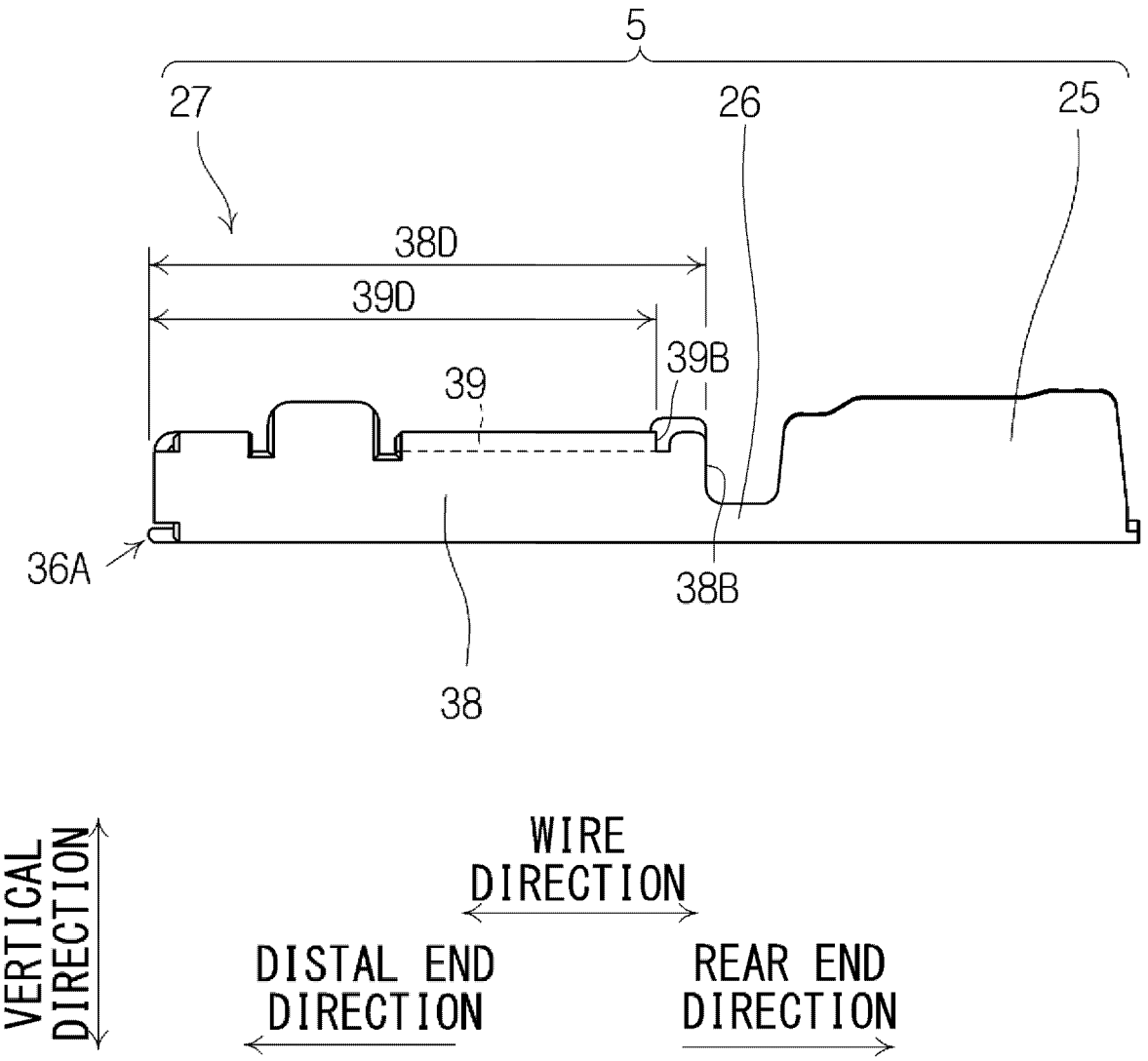
FIG. 9 is a front view of the terminal before being attached to the wire (first embodiment).

The terminal 5 is described hereinafter with reference to FIGS. 7 to 9. FIG. 7 is a perspective view of the terminal 5 before being attached to the wire 4. FIG. 8 is a partially cutaway perspective view of the terminal 5 before being attached to the wire 4. FIG. 9 is a front view of the terminal 5 before being attached to the wire 4.

As shown in FIG. 7, the terminal 5 includes a wire crimp part 25, a terminal joint part 26, and an electrical contact part 27. The wire crimp part 25, the terminal joint part 26, and the electrical contact part 27 are continuously formed in this recited order in the distal end direction. The terminal joint part 26 joins the wire crimp part 25 and the electrical contact part 27 together.

The wire crimp part 25 is a part to be crimped onto the wire 4. As shown in FIG. 7, the wire crimp part 25 is formed in an open barrel shape in this embodiment. Specifically, the wire crimp part 25 includes a bottom plate part 28 and two crimp pieces 29. As shown in FIG. 8, the thickness direction of the bottom plate part 28 is substantially parallel to the vertical direction. The two crimp pieces 29 extend upward from the end of the bottom plate part 28 in the width direction. Thus, when viewing the electrical contact part 27 from the wire crimp part 25 in the wire direction, the wire crimp part 25 has a U-shape that opens upward. On an inner surface 30 of each crimp piece 29, a distal end serration 31, a center serration 32, and a rear end serration 33 are formed in this recited order in the rear end direction. In this embodiment, each of the distal end serration 31 and the rear end serration 33 is in the form of a straight gash that extends linearly in the direction orthogonal to the wire direction. Further, in this embodiment, the center serration 32 is in the form of a plurality of recesses arranged in a matrix.

The electrical contact part 27 is a part that is capable of coming into electrical contact with a mating terminal, which is not shown. The electrical contact part 27 includes a contact spring piece 35 and a spring protector 36 that accommodates and protects the contact spring piece 35.

As shown in FIG. 7, the spring protector 36 is a rectangular tube that extends in the wire direction. As shown in FIGS. 7 and 8, the spring protector 36 includes a bottom plate part 37, two side plate parts 38, and a top plate part 39 that is opposed to the bottom plate part 37. The bottom plate part 37 and the top plate part 39 are opposed to each other in the vertical direction. The top plate part 39 is disposed above the bottom plate part 37. The two side plate parts 38 are opposed to each other in the width direction. As shown in FIG. 9, a length 39D from a distal end 36A of the spring protector 36 to a rear end 39B of the top plate part 39 is smaller than a length 38D from the distal end 36A of the spring protector 36 to a rear end 38B of the two side plate parts 38. Thus, as shown in FIG. 7, the top plate part 39 can be regarded as being cut away in close proximity to a rear end 36B of the spring protector 36. Note that the rear end 38B of the two side plate parts 38 shown in FIG. 9 is capable of coming into contact with a retainer, which is described later, in the wire direction.

As shown in FIG. 8, the contact spring piece 35 is accommodated in the rectangular tubular spring protector 36 and thereby protected by the spring protector 36. The contact spring piece 35 is elongated in the wire direction. The contact spring piece 35 is supported like a cantilever beam by the spring protector 36.

As shown in FIG. 7, the terminal joint part 26 is a part that joins the wire crimp part 25 and the electrical contact part 27 together. As shown in FIG. 8, the terminal joint part 26 includes a bottom plate part 45 and two side plate parts 46. The thickness direction of the bottom plate part 45 is substantially parallel to the vertical direction. The two side plate parts 46 extend upward from the end of the bottom plate part 45 in the width direction. The bottom plate part 45 joins the bottom plate part 28 of the wire crimp part 25 and the bottom plate part 37 of the spring protector 36 of the electrical contact part 27 together in the wire direction. Likewise, each side plate part 46 joins each crimp piece 29 of the wire crimp part 25 and each side plate part 38 of the electrical contact part 27 together in the wire direction. Since the two side plate parts 46 of the terminal joint part 26 have a lower height than the two crimp pieces 29 of the wire crimp part 25 and the two side plate parts 38 of the electrical contact part 27, a retainer insertion space 47 where a retainer, which is described later, is able to be inserted is left between the wire crimp part 25 and the electrical contact part 27.

The terminal 5 described above is produced by plating with a base metal, such as tin, nickel or zinc, a single thin plate made of copper or a copper alloy and then pressing it, for example. The terminal 5, however, may be produced by pressing a thin plate and then plating it.

<Wire with Terminal 3>

Figure 10:
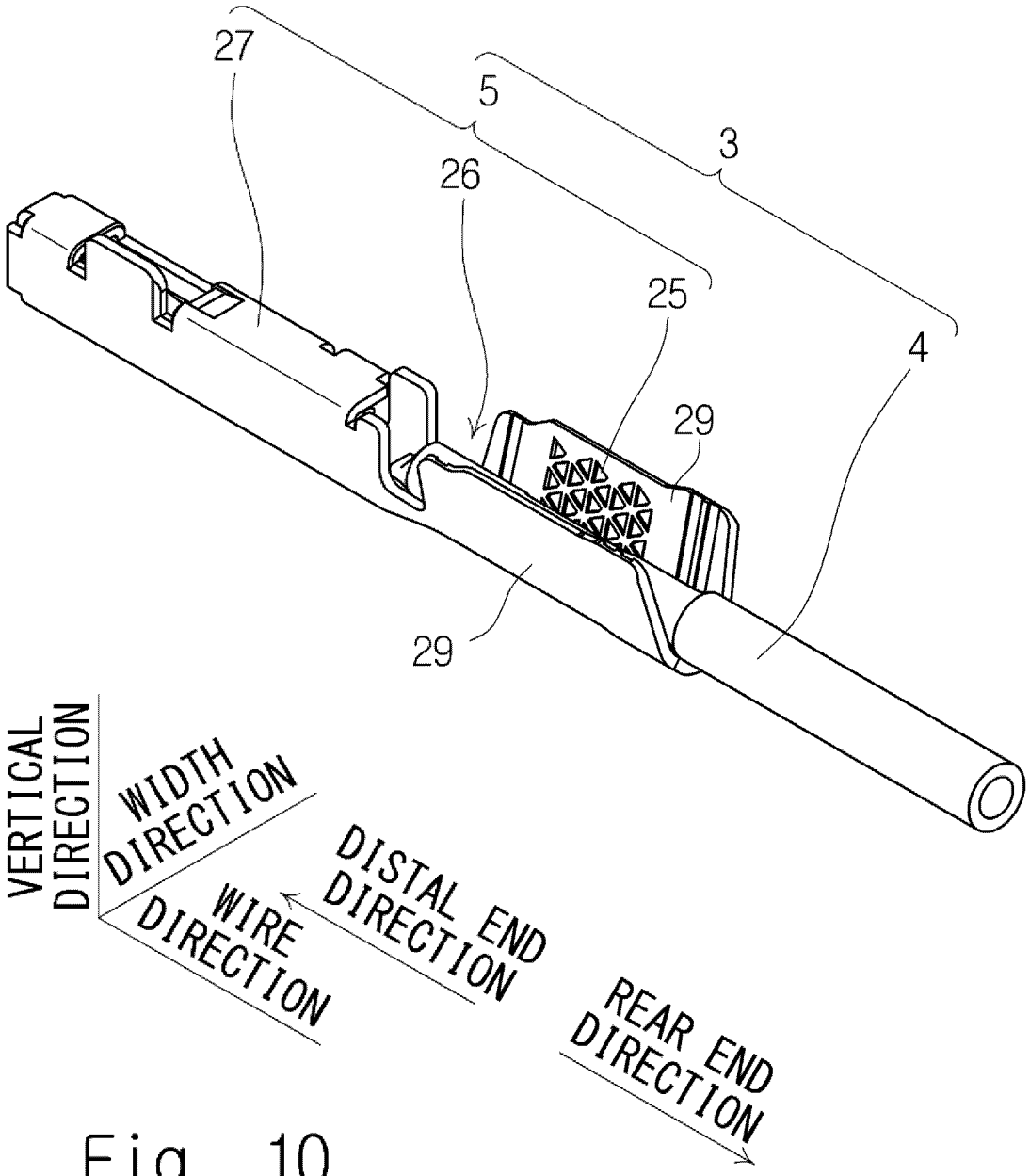
FIG. 10 is a perspective view of the terminal and the wire immediately before the terminal is crimped onto the wire (first embodiment).
Figure 11:
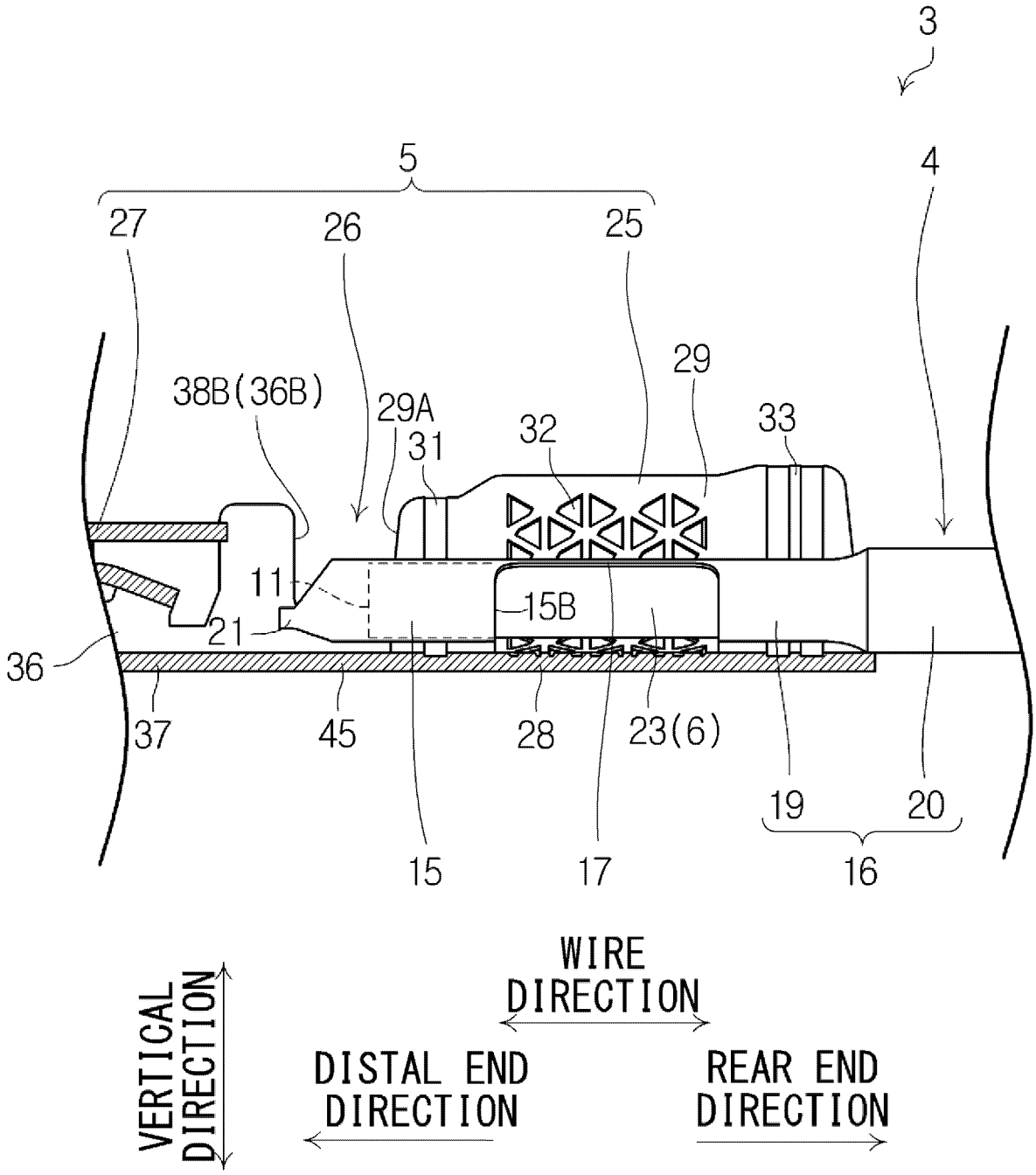
FIG. 11 is a front cross-sectional view of the terminal and the wire immediately before the terminal is crimped onto the wire (first embodiment).
Figure 12:
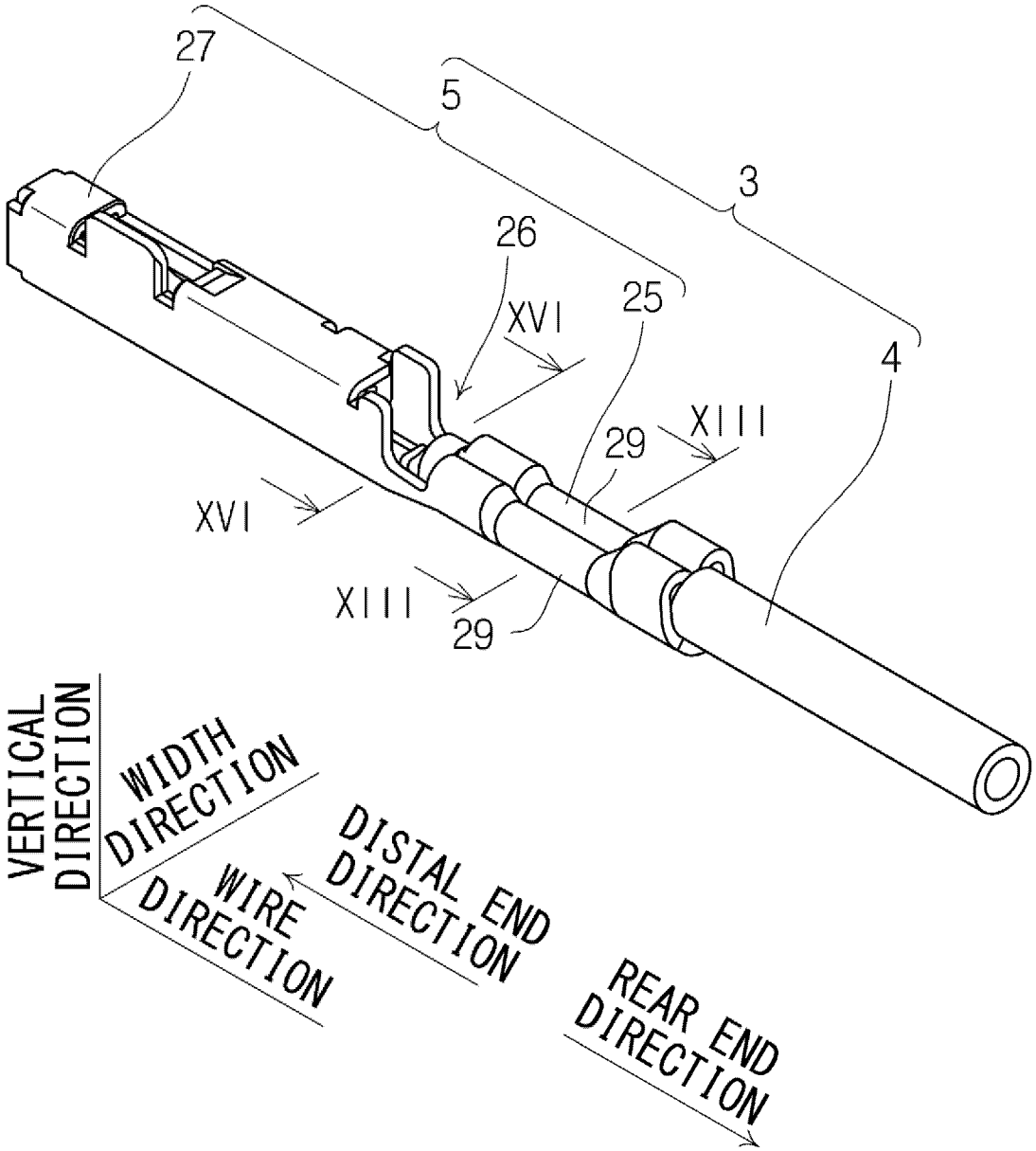
FIG. 12 is a perspective view of the terminal and the wire after the terminal is crimped onto the wire (first embodiment).
Figure 13:
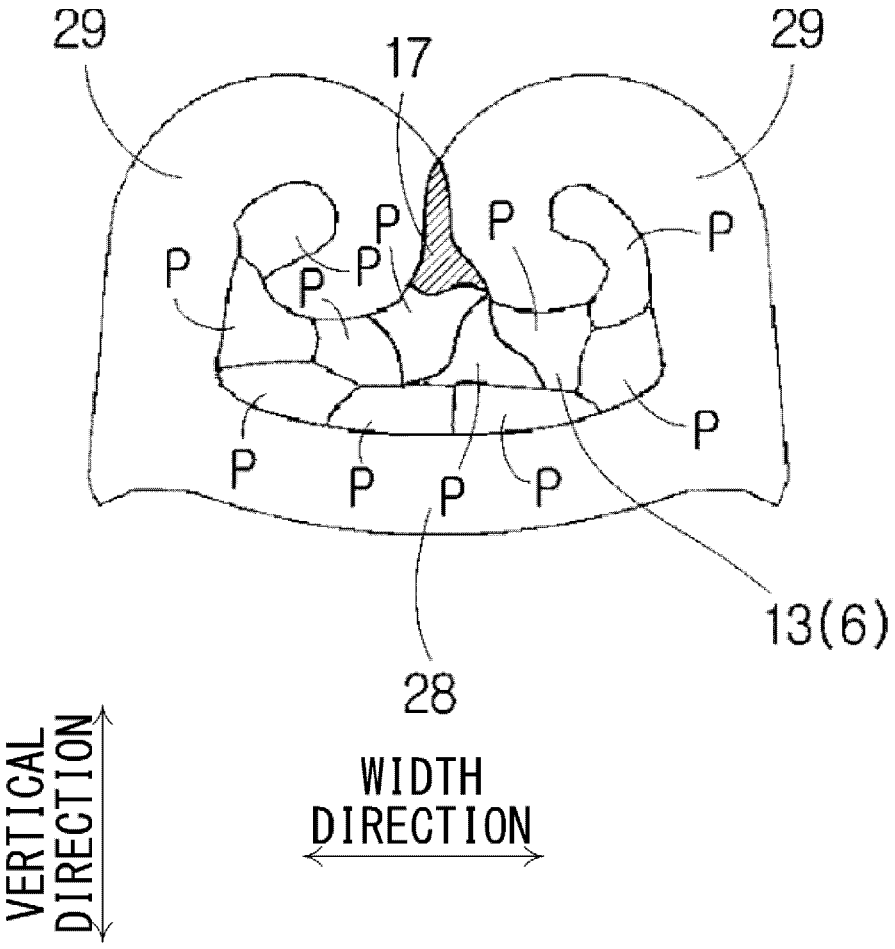
FIG. 13 is a cross-sectional view along line XIII-XIII of FIG. 12 (first embodiment).
Figure 14:
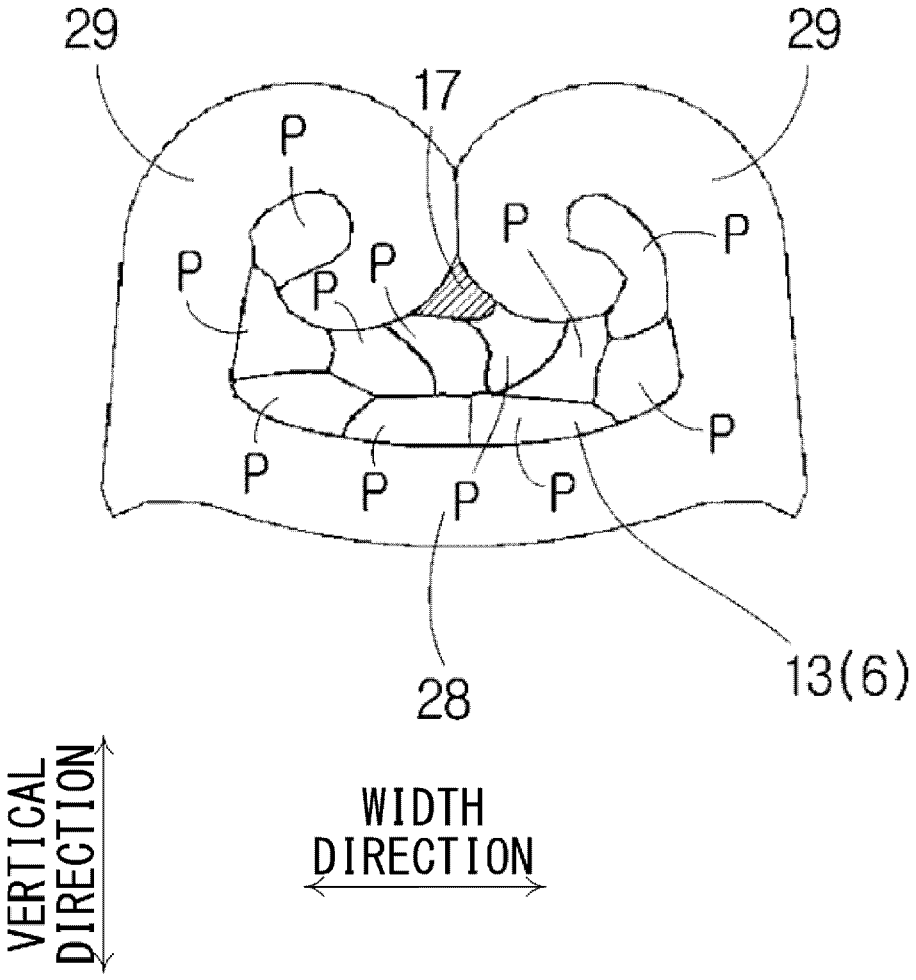
FIG. 14 is a cross-sectional view along line XIII-XIII of FIG. 12 (first embodiment).
Figure 15:
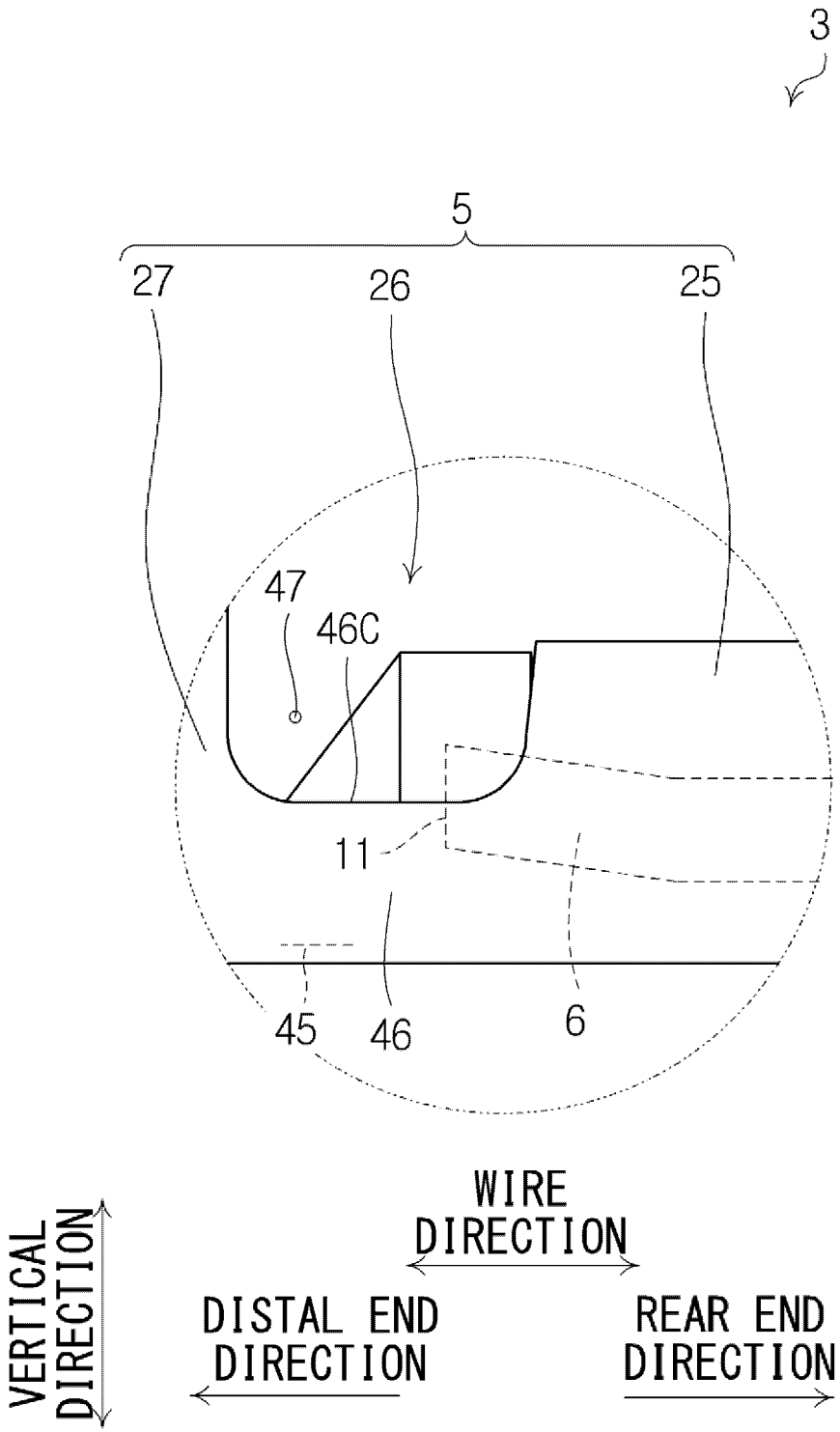
FIG. 15 is a partial front view of the terminal and the wire after the terminal is crimped onto the wire (first embodiment).
Figure 16:
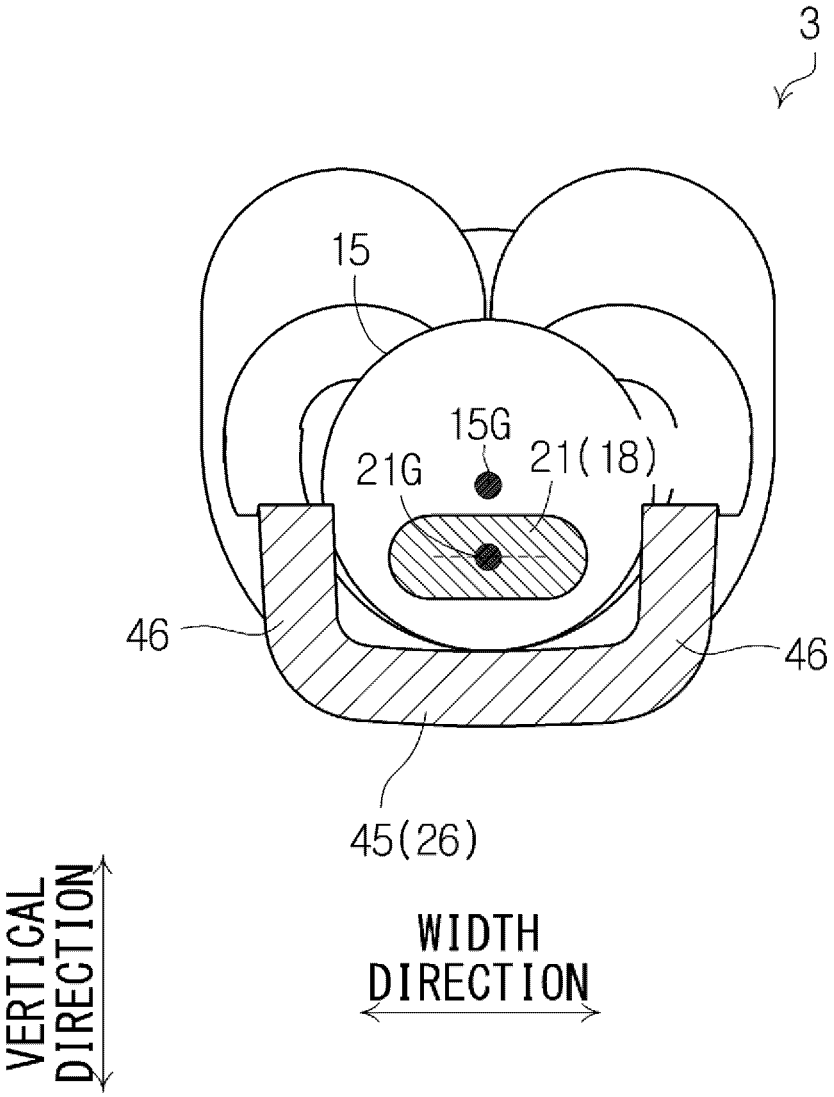
FIG. 16 is a cross-sectional view along line XVI-XVI of FIG. 12 (first embodiment).

The wire with terminal 3 is described hereinafter with reference to FIGS. 10 to 16. FIG. 10 is a perspective view of the terminal 4 and the wire 5 immediately before the terminal 4 is crimped onto the wire 5. FIG. 11 is a front cross-sectional view of the terminal 4 and the wire 5 immediately before the terminal 4 is crimped onto the wire 5. FIG. 12 is a perspective view of the terminal 4 and the wire 5 after the terminal 4 is crimped onto the wire 5. FIGS. 13 and 14 are cross-sectional views along line XIII-XIII of FIG. 12. FIG. 15 is a partial front view of the terminal 4 and the wire 5 after the terminal 4 is crimped onto the wire 5. FIG. 16 shows another specific example of a cross-sectional view along line XVI-XVI of FIG. 12.

To crimp the above-described terminal 5 onto the wire 4, as shown in FIG. 10, the wire 4 is first disposed between the two crimp pieces 29 of the wire crimp part 25.

To be specific, as shown in FIG. 11, the wire 4 is disposed between the two crimp pieces 29 of the wire crimp part 25 so as to satisfy the following conditions.

(1) In the wire direction, the welded part 21 is located toward the rear end direction relative to the contact spring piece 35 shown in FIG. 8. This prevents the welded part 21 from inhibiting the movement of the contact spring piece 35.

(2) In the vertical direction, the welded part 21 is disposed in closest proximity to the bottom plate part 45 of the terminal joint part 26. This allows the retainer insertion space 47 shown in FIG. 8 to be large. Alternatively, in the wire direction, the welded part 21 may be disposed toward the rear end direction relative to the retainer insertion space 47 shown in FIG. 8. This also allows the retainer insertion space 47 shown in FIG. 8 to be large. Note that, however, when the retainer insertion space 47 is not needed, the disposition of the welded part 21 is arbitrary.

(3) In the wire direction, the distal end surface 11 of the core wire 6 is located between the rear end 36B of the spring protector 36 of the electrical contact part 27 and a distal end 29A of the two crimp pieces 29 of the wire crimp part 25. Note that, however, since there is a possibility that the core wire 6 extends and the distal end surface 11 of the core wire 6 shifts in the distal end direction at the time of crimping, the distal end surface 11 of the core wire 6 may be simply located in close proximity to the distal end 29A of the two crimp pieces 29 of the wire crimp part 25 rather than being located between the rear end 36B of the spring protector 36 of the electrical contact part 27 and the distal end 29A of the two crimp pieces 29 of the wire crimp part 25.

(4) In the wire direction, a rear end 15B of the distal end coating part 15 is located between the distal end serration 31 and the center serration 32.

(5) In the radial direction of the wire 4, the distal end coating part 15 is opposed to the distal end serration 31.

(6) In the wire direction, the coating joint part 17 is located between the distal end serration 31 and the rear end serration 33.

(7) In the wire direction, a core wire exposure part 23, which is a part of the core wire 6 exposed between the distal end coating part 15 and the insulation coating body 16, is located between the distal end serration 31 and the rear end serration 33.

(8) In the radial direction of the wire 4, the core wire exposure part 23 is opposed to the center serration 32.

(9) In the vertical direction, the core wire exposure part 23 is opposed to the bottom plate part 28 of the wire crimp part 25.

(10) In the vertical direction, the coating joint part 17 is located farthest from the bottom plate part 28 of the wire crimp part 25.

(11) In the radial direction of the wire 4, the first body part 19 is opposed to the rear end serration 33.

(12) In the radial direction of the wire 4, the second body part 20 is not opposed to the two crimp pieces 29.

After the wire 4 is disposed between the two crimp pieces 29 of the wire crimp part 25 as described above, the two crimp pieces 29 of the wire crimp part 25 of the terminal 5 are crimped to the wire 4 as shown in FIG. 12 by using a dedicated crimp tool. To be specific, each crimp piece 29 is crimped to the distal end coating part 15 shown in FIG. 11, the coating joint part 17 and the core wire exposure part 23, and the first body part 19. At the time of crimping, as shown in FIGS. 13 and 14, the two crimp pieces 29 are plastically deformed inward in such a way that the two crimp pieces 29 come into close contact with each other and the two crimp pieces 29 are bent to be convex inward. FIGS. 13 and 14 show a plurality of individual wires P that constitute the core wire 6. In FIGS. 13 and 14, no hatching is shown on the cross-section of the terminal 5 and the wire 6 for the convenience of description. As shown in FIGS. 13 and 14, the coating joint part 17 is crushed in the width direction between the two crimp pieces 29, so that the coating joint part 17 contributes airtightness between the two crimp pieces 29. Note that, in the specific example shown in FIG. 13, the area of contact between the two crimp pieces 29 is relatively small, and the coating joint part 17 stretches in the vertical direction between the two crimp pieces 29. On the other hand, in the specific example shown in FIG. 14, the area of contact between the two crimp pieces 29 is relatively large, and the coating joint part 17 is deformed into a substantially equilateral triangle between the two crimp pieces 29. As shown in FIGS. 13 and 14, since the cross-sectional area of the coating joint part 17 is small in this embodiment, the coating joint part 17 is not spread out in the width direction at the time of crimping, and therefore inhibition of electrical contact between the individual wires P that constitute the core wire 6 and each crimp piece 29 does not occur.

Note that, in the specific example shown in FIG. 13, the second distal end region 13 is more reliably sealed than in the specific example shown in FIG. 14. Specifically, in the specific example shown in FIG. 13, when the two crimp pieces 29 spring back, the coating joint part 17 is crushed in the width direction by the two crimp pieces 29, and therefore the airtightness between the two crimp pieces 29 is improved. On the other hand, in the specific example shown in FIG. 14, when the two crimp pieces 29 spring back, there is a possibility that a gap occurs in the vicinity of the coating joint part 17, such as between a point of contact between the two crimp pieces 29 and the coating joint part 17. Hence, as in the specific example shown in FIG. 13, it is advantageous for the sealing of the second distal end region 13, which is, the waterproof capability of the second distal end region 13 that, in the state where the terminal 5 is crimped onto the wire 4, the two crimp pieces 29 are not in direct contact with each other, and the coating joint part 17 is interposed between the two crimp pieces 29 in the width direction in such a way that the two crimp pieces 29 compress the coating joint part 17 in the width direction.

As a result of the above-described crimping, the distal end coating part 15 bites into the distal end serration 31 of each crimp piece 29 shown in FIG. 11, and also the first body part 19 bites into the rear end serration 33 of each crimp piece 29, and consequently the core wire exposure part 23 is successfully sealed by the wire crimp part 25, the distal end coating part 15 and the first body part 19. Further, the center serration 32 bites into the core wire exposure part 23, and consequently a passivation film of the core wire 6 is locally removed, which establishes good continuity of the terminal 5 and the core wire 6. Note that the distal end surface 11 of the core wire 6 is sealed as a result that the welded part 21 is formed in the coating extension part 18.

As shown in FIG. 15, the core wire 6 is located above the terminal joint part 26 between the electrical contact part 27 and the wire crimp part 25. Specifically, in this embodiment, at least part of the core wire 6 is located above an upper end 46C of the two side plate parts 46 of the terminal joint part 26 between the electrical contact part 27 and the wire crimp part 25. In other words, at least part of the core wire 6 is farther from the bottom plate part 45 than the upper end 46C is. This enables confirmation as to whether the distal end surface 11 of the core wire 6 is located between the electrical contact part 27 and the wire crimp part 25 after crimping by applying an X-ray to the wire with terminal 3 in the width direction. Instead of an X-ray, an ultrasonic wave may be used.

Further, as shown in FIG. 16, in this embodiment, when viewing the wire crimp part 25 from the electrical contact part 27 in the wire direction, the center of gravity 21G of the cross-section of the welded part 21 is located between the center of gravity 15G of the cross-section of the distal end coating part 15 and the bottom plate part 45 of the terminal joint part 26 in the vertical direction. In this structure, as shown in FIG. 15, the retainer insertion space 47 into which a retainer, which is described later, is inserted is effectively provided between the electrical contact part 27 and the wire crimp part 25.

<Harness 1>

Figure 17:
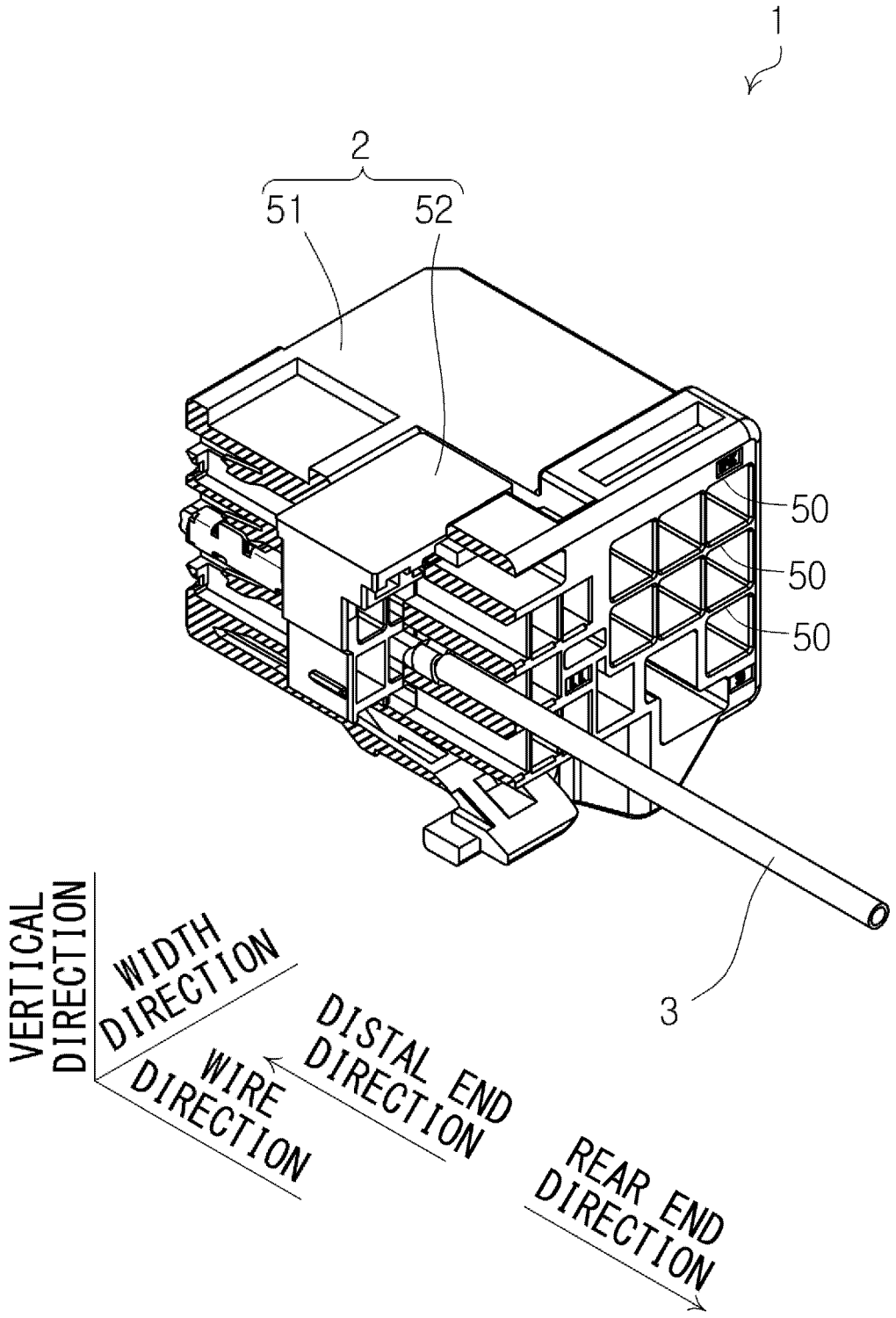
FIG. 17 is a partially cutaway perspective view of the harness (first embodiment).
Figure 18:
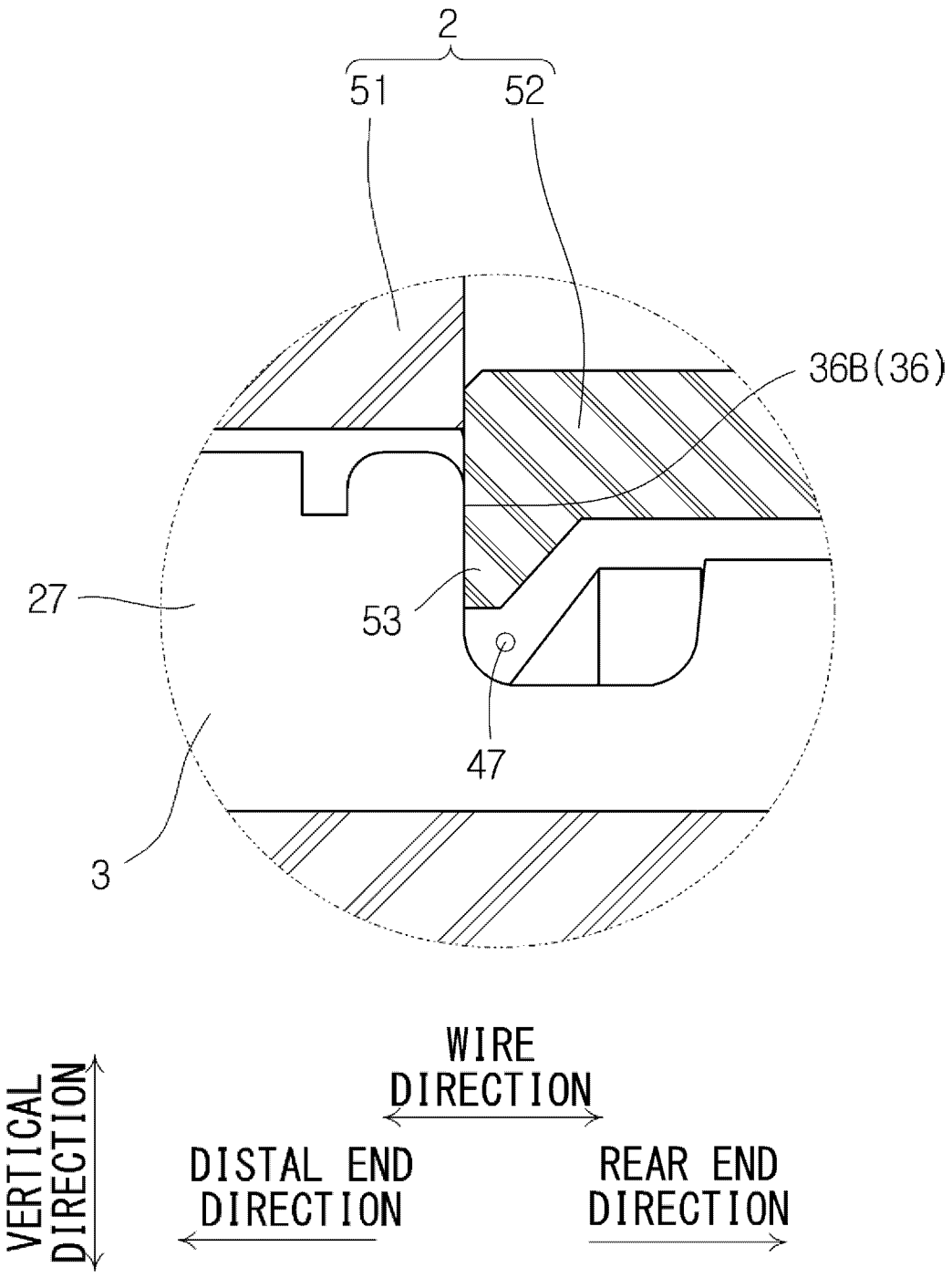
FIG. 18 is a partial front cross-sectional view of the harness (first embodiment).

The harness 1 is described hereinafter with reference to FIGS. 17 and 18. FIG. 17 is a partially cutaway perspective view of the harness 1. FIG. 18 is a partial front cross-sectional view of the harness 1.

As shown in FIG. 17, the housing 2 includes a housing body 51 having a plurality of cavities 50 into which the wire with terminal 3 is able to be inserted in the wire direction, and a retainer 52 for secondary locking. The retainer 52 is held to be vertically movable with respect to the housing body 51. The retainer 52 is located opposite to the rear end 36B of the spring protector 36 of the wire with terminal 3 in the wire direction and thereby controls the detachment of the wire with terminal 3 in the rear end direction.

As shown in FIG. 18, the retainer 52 has a locking lance 53 that is able to be inserted into the retainer insertion space 47 of the wire with terminal 3. Then, as shown in FIG. 18, when the retainer 52 is pulled down, the locking lance 53 is inserted into the retainer insertion space 47 of the wire with terminal 3, and the locking lance 53 thereby becomes capable of coming into contact with the rear end 36B of the spring protector 36 in the wire direction. In other words, when the retainer 52 is pulled down, the locking lance 53 becomes capable of coming into contact with the rear end 38B of each side plate part 38 of the spring protector 36 shown in FIG. 9. Thus, even when the wire with terminal 3 is tried to pull out of the housing 2, the rear end 36B of the spring protector 36 catches on the locking lance 53, thereby prohibiting the wire with terminal 3 from being pulled out of the housing 2.

<Manufacturing Method for Wire with Terminal 3>

Figure 19:
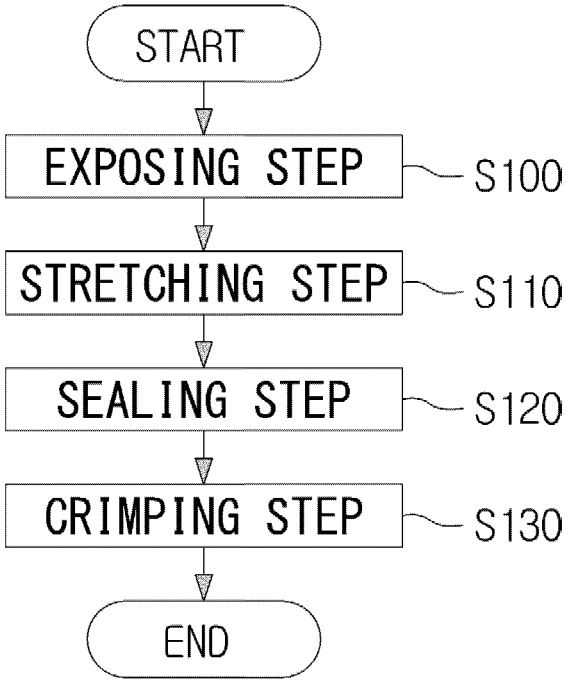
FIG. 19 is a flowchart of a manufacturing method for a wire with a terminal (first embodiment).

A manufacturing method for the wire 4 and a manufacturing method for the wire with terminal 3 are described hereinafter with reference to FIGS. 19 to 21. FIG. 19 is a flowchart of a manufacturing method for the wire with terminal 3. FIGS. 20A to 20C are views illustrating each step of the manufacturing method for the wire with terminal 3. FIG. 21 is a perspective view of a processing jig.

Step S100: Exposing Step

Figure 20A:
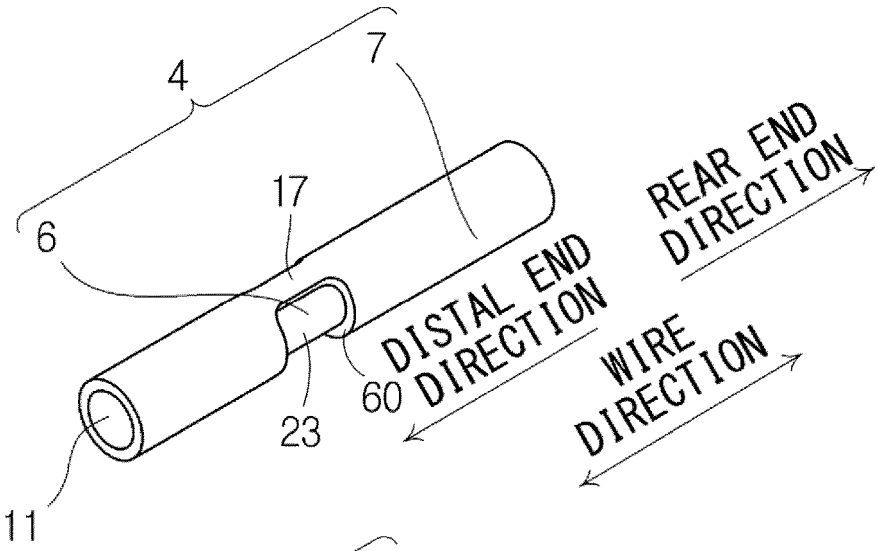
FIG. 20A is a view illustrating each step of the manufacturing method for a wire with a terminal (first embodiment).
Figure 21:
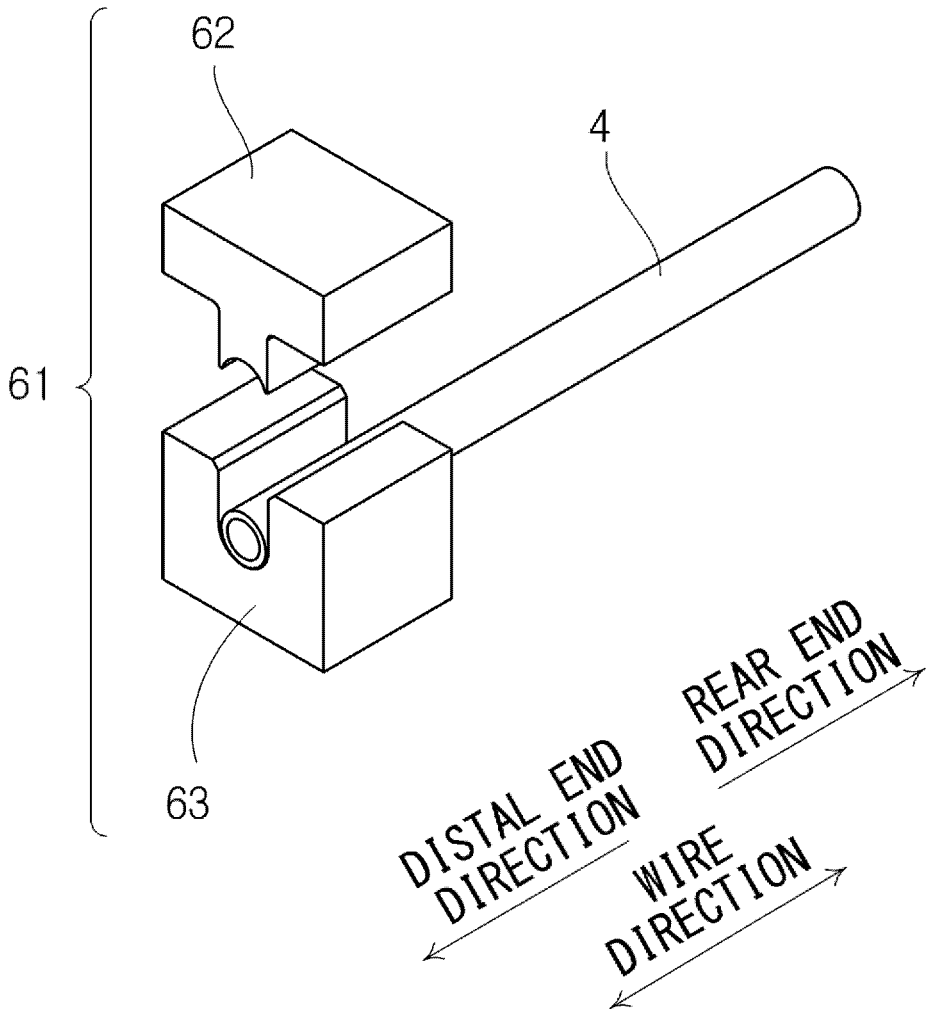
FIG. 21 is a perspective view of a processing jig (first embodiment).

First, as shown in FIG. 20A, the insulation coating 7 is partly removed in close proximity to the distal end surface 11 of the core wire 6, so that the insulation coating 7 has a core wire exposure hole 60 (hole). The coating joint part 17 is thereby formed, and a core wire exposure part 23 is also made. A method of partly removing the insulation coating 7 may be (1) a method including a step of cutting a slit in the insulation coating 7 with a cutting tool, (2) a method including a step of cutting a slit in the insulation coating 7 by laser processing, (3) a method including a step of partly evaporating the insulation coating 7 by laser processing, and so on.

Step S110: Stretching Step

Figure 20B:
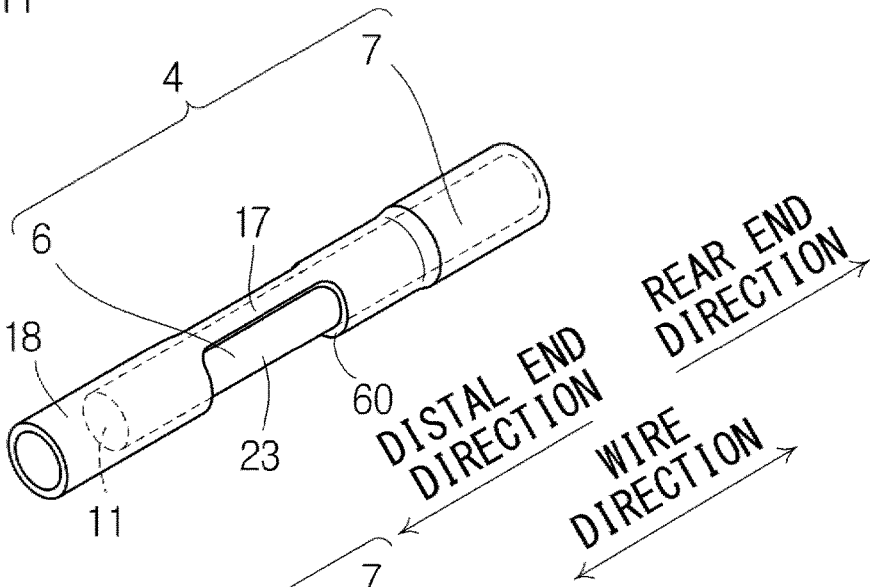
FIG. 20B is a view illustrating each step of the manufacturing method for a wire with a terminal (first embodiment).

Next, as shown in FIG. 20B, the insulation coating 7 is stretched in the distal end direction in such a way that the insulation coating 7 extends beyond the distal end surface 11. To be specific, the insulation coating 7 is stretched in the distal end direction in such a way that the opening area of the core wire exposure hole 60 made in Step S100 is enlarged. To be more specific, the insulation coating 7 is stretched in the distal end direction in such a way that the coating joint part 17 formed in Step S100 becomes thinner than that before stretching. It is preferred to use a processing jig 61 shown in FIG. 21 in order to stretch the insulation coating 7 without splitting it. The processing jig 61 includes an upper jig 62 and a lower jig 63. The wire 4 is sandwiched between the upper jig 62 and the lower jig 63, and then the processing jig 61 is moved in the distal end direction while the wire 4 is heated indirectly through the upper jig 62 and the lower jig 63. As a result, as shown in FIG. 20B, the coating extension part 18, which is a part of the insulation coating 7 extending beyond the distal end surface 11 in the distal end direction, is formed.

Step S120: Sealing Step

Figure 20C:
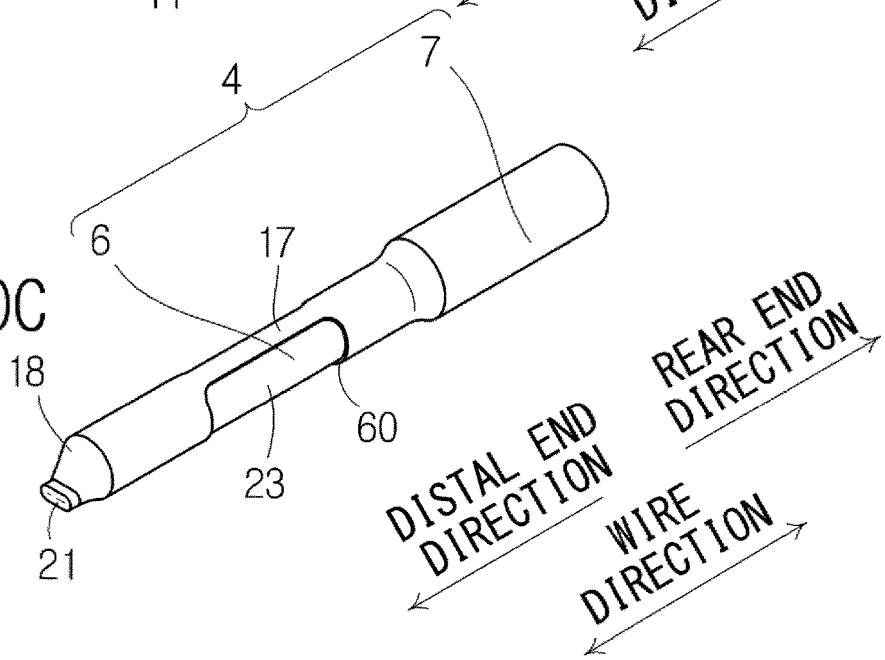
FIG. 20C is a view illustrating each step of the manufacturing method for a wire with a terminal (first embodiment).

Then, as shown in FIG. 20C, the coating extension part 18 is crushed in the vertical direction, and the crushed part is closed by welding, and thereby the welded part 21 is formed in the coating extension part 18. The distal end surface 11 is thereby sealed. The step of crushing and the step of closing by welding may be performed simultaneously.

Step S130: Crimping Step

After that, the terminal 5 is crimped onto the wire 4. The wire with terminal 3 is thereby produced.

The first embodiment is described above. The above-described first embodiment has the following features.

As shown in FIG. 4, the wire 4 includes the core wire 6 and the insulation coating 7 that covers the outer periphery of the core wire 6. The core wire 6 includes the distal end region 9 containing the distal end surface 11 of the core wire 6, and the body region 10, which is a part other than the distal end region 9. The distal end region 9 includes the first distal end region 12 containing the distal end surface 11, and the second distal end region 13 located between the first distal end region 12 and the body region 10. The insulation coating 7 includes the distal end coating part 15 that covers the outer periphery of the first distal end region 12 in a tube shape, the insulation coating body 16 that covers the outer periphery of the body region 10 in a tube shape, the coating joint part 17 that joins the distal end coating part 15 and the insulation coating body 16 together in such a way that at least part of the outer periphery of the second distal end region 13 is exposed, and the coating extension part 18 that extends from the distal end coating part 15 beyond the distal end surface 11 in a tube shape. This structure is capable of effectively sealing the distal end surface 11 by using the coating extension part 18 as well as preventing the distal end coating part 15 from coming off the core wire 6 by the presence of the coating joint part 17.

Note that, if sebum on a worker's finger or the like is attached to the distal end surface 11 of the core wire 6, there is a possibility that the properties of the distal end surface 11 change, or a sealing material 67 is difficult to be attached to the distal end surface 11. In the above-described structure, however, a worker's finger is not likely to directly touch the distal end surface 11 of the core wire 6 because of the presence of the coating extension part 18, which effectively prevents sebum on a worker's finger or the like from being attached to the distal end surface 11 of the core wire 6.

Further, as shown in FIG. 5, the thickness 17T of the coating joint part 17 in the radial direction is smaller than the thickness 20T which corresponds to the maximum thickness of the insulation coating body 16 in the radial direction. Thus, when crimping the wire 5 onto the second distal end region 13, it is likely that the coating joint part 17 is spread out in the width direction in the terminal 5, which can inhibit contact between the second distal end region 13 and the wire 5. On the other hand, in the above-described structure, the cross-section of the coating joint part 17 is small as shown in FIGS. 13 and 14, and therefore the coating joint part 17 is not easily spread out in the width direction. The degree of inhibiting contact between the second distal end region 13 and the wire 5 is thereby reduced, which improves the contact reliability between the second distal end region 13 and the wire 5.

Further, as shown in FIG. 4, the insulation coating body 16 includes the first body part 19 that touches the coating joint part 17, and the second body part 20 that is farther from the distal end surface 11 than the first body part 19 is. As shown in FIG. 5, the thickness 19T of the first body part 19 in the radial direction is the same as the thickness 17T of the coating joint part 17 in the radial direction. The thickness 20T of the second body part 20 in the radial direction is greater than the thickness 19T of the first body part 19 in the radial direction. In this structure, a difference between the outer diameter of the second distal end region 13 and the outer diameter of the first body part 19 is small, and accordingly a difference in level between the second distal end region 13 and the first body part 19 is small, which improves airtightness between the second distal end region 13 and the terminal 5.

Further, as shown in FIG. 4, the welded part 21 that is crushed in the vertical direction (a cross direction crossing the longitudinal direction of the wire 4) and closed by welding is formed in the coating extension part 18. In this structure, the distal end surface 11 is reliably sealed.

Further, as shown in FIG. 6, when viewing in the wire direction (in the longitudinal direction of the wire), the center of gravity 21G of the cross-section of the welded part 21 orthogonal to the wire direction and the center of gravity 15G of the cross-section of the distal end coating part 15 orthogonal to the wire direction do not coincide. In this manner, since the welded part 21 is asymmetric with respect to the central axis 6C, the current position of the coating joint part 17 in the circumferential direction is identifiable by detecting the current position of the welded part 21 in the circumferential direction. If the current position of the coating joint part 17 in the circumferential direction is identifiable, the position of the coating joint part 17 in the circumferential direction is freely adjustable when crimping the terminal 5 onto the wire 4.

Further, as shown in FIG. 6, when viewing in the wire direction (in the longitudinal direction of the wire), the center of gravity 21G of the cross-section of the welded part 21 orthogonal to the wire direction and the center of gravity 15G of the cross-section of the distal end coating part 15 orthogonal to the wire direction do not coincide. In this manner, when the welded part 21 is asymmetric with respect to the central axis 6C, the current position of the welded part 21 in the circumferential direction is easily recognizable based on the position of the coating joint part 17 in the circumferential direction.

Further, as shown in FIG. 4, the welded part 21 is formed to avoid the virtual extension line 6D of the central axis 6C of the core wire 6. In this structure, the retainer insertion space 47 shown in FIG. 15 is effectively provided.

Further, as shown in FIG. 6, the cross-sectional shape of the welded part 21 orthogonal to the wire direction is a track shape. This structure allows a welding jig of the welded part 21 to have a simple structure.

Further, as shown in FIG. 4, when forming the welded part 21 in the coating extension part 18, the direction of crushing the coating extension part 18 is preferably the vertical direction orthogonal to the wire direction. Note that, however, the coating extension part 18 may be crushed in the direction obliquely intersecting the wire direction.

Further, as shown in FIG. 2, the wire with terminal 3 includes the above-described wire 4, and the terminal 5 attached to the wire 4. As shown in FIG. 7, the terminal 5 includes the electrical contact part 27 that is capable of coming into electrical contact with a mating terminal, the wire crimp part 25 to be crimped onto the wire 4, and the terminal joint part 26 that joins the electrical contact part 27 and the wire crimp part 25 together. The wire crimp part 25 includes two crimp pieces 29. As shown in FIG. 11, each crimp piece 29 is crimped onto the distal end coating part 15, the core wire exposure part 23 (the second distal end region 13) and the insulation coating body 16, and thereby the core wire exposure part 23 (the second distal end region 13) is sealed.

Further, as shown in FIG. 16, when viewing the wire crimp part 25 from the electrical contact part 27 in the longitudinal direction of the wire 4, the center of gravity 21G of the cross-section of the welded part 21 orthogonal to the longitudinal direction of the wire 4 is located between the center of gravity 15G of the cross-section of the distal end coating part 15 orthogonal to the longitudinal direction of the wire 4 and the terminal joint part 26. In this structure, as shown in FIG. 18, the retainer insertion space 47 is effectively provided.

Further, as shown in FIG. 1, the harness 1 includes the wire with terminal 3, and the housing 2 that accommodates the wire with terminal 3. As shown in FIG. 18, the housing 2 includes the retainer 52 that is capable of coming into contact with the rear end 36B of the spring protector 36 of the electrical contact part 27 in the wire direction.

Further, as shown in FIGS. 20A and 20B, a manufacturing method for the wire 4 includes the exposing step (S100) of exposing at least part of the core wire 6 by making the core wire exposure hole 60 (hole) in the insulation coating 7 that covers the core wire 6, and the stretching step (S110) of stretching the insulation coating 7 in such a way that the insulation coating 7 extends beyond the distal end surface 11 of the core wire 6. This method is capable of forming the coating extension part 18 suitable for sealing the distal end surface 11 of the core wire 6 as well as preventing the distal end coating part 15 from coming off the core wire 6.

Further, as shown in FIG. 19, the stretching step (S110) is performed after the exposing step (S100). As shown in FIGS. 20A and 20B, in the stretching step (S110), the insulation coating 7 is stretched in such a way that the opening area of the core wire exposure hole 60 made in the exposing step (S100) is enlarged. This method is capable of making the coating joint part 17 thinner than that before stretching Further, as shown in FIGS. 20A and 20B, the manufacturing method for the wire 4 further includes the step (S120) of crushing the coating extension part 18, which is a part of the insulation coating 7 extending beyond the distal end surface 11 of the core wire 6, in the cross direction crossing the longitudinal direction of the core wire 6, and the step (S120) of closing the crushed part by welding. This method is capable of sealing the distal end surface 11 at low cost.

Second Embodiment

Figure 22:
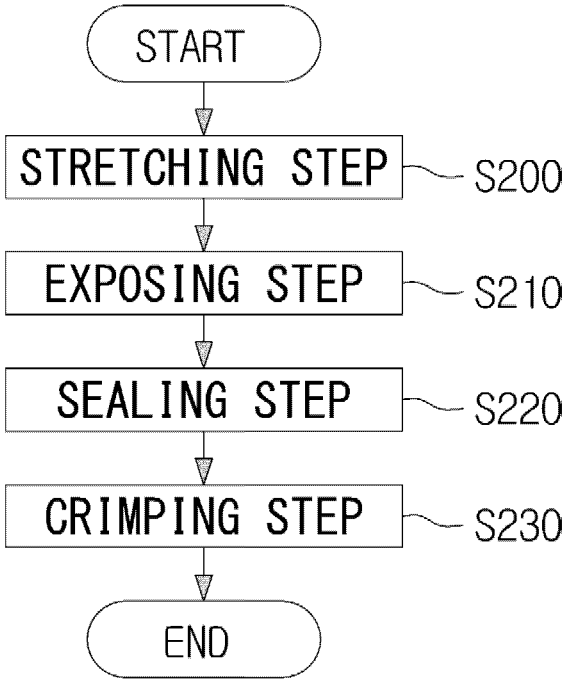
FIG. 22 is a flowchart of a manufacturing method for a wire with a terminal (second embodiment).

A second embodiment is described hereinafter with reference to FIGS. 22 to 23D. Hereinafter, differences from the above-described first embodiment are mainly described, and redundant description is omitted. FIG. 22 is a flowchart of a manufacturing method for the wire with terminal 3. FIGS. 23A to 23D are views illustrating each step of the manufacturing method for the wire with terminal 3.

This embodiment is different from the above-described first embodiment in the manufacturing method for the wire with terminal 3.

Specifically, in the above-described first embodiment, as shown in FIG. 19, the exposing step (S100) is performed first, and the stretching step (S110) is performed after that. On the other hand, in this embodiment, a stretching step (S200) is performed first, and an exposing step (S210) is performed after that. The specific description is as follows.

Step S200: Stretching Step

Figure 23A:
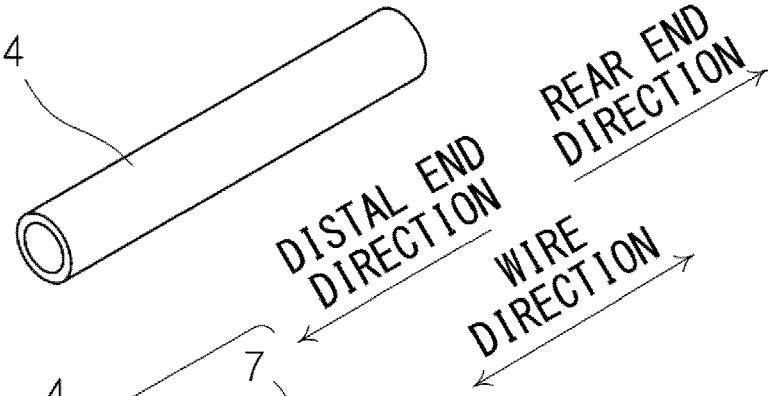
FIG. 23A is a view illustrating each step of the manufacturing method for a wire with a terminal (second embodiment).
Figure 23B:
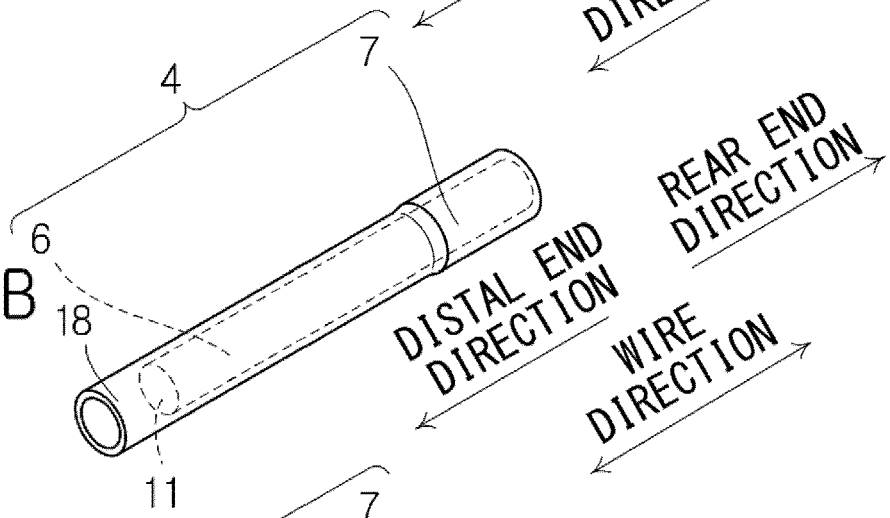
FIG. 23B is a view illustrating each step of the manufacturing method for a wire with a terminal (second embodiment).

First, as shown in FIGS. 23A and 23B, the insulation coating 7 is stretched in the distal end direction in such a way that the insulation coating 7 extends beyond the distal end surface 11. As a result, as shown in FIG. 23B, the coating extension part 18, which is a part of the insulation coating 7 extending beyond the distal end surface 11, is formed.

Step S210: Exposing Step

Figure 23C:
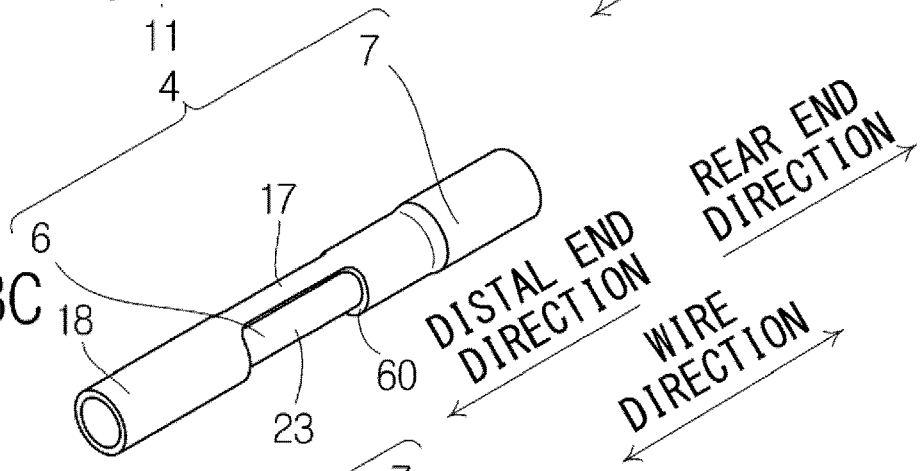
FIG. 23C is a view illustrating each step of the manufacturing method for a wire with a terminal (second embodiment).
Figure 23D:
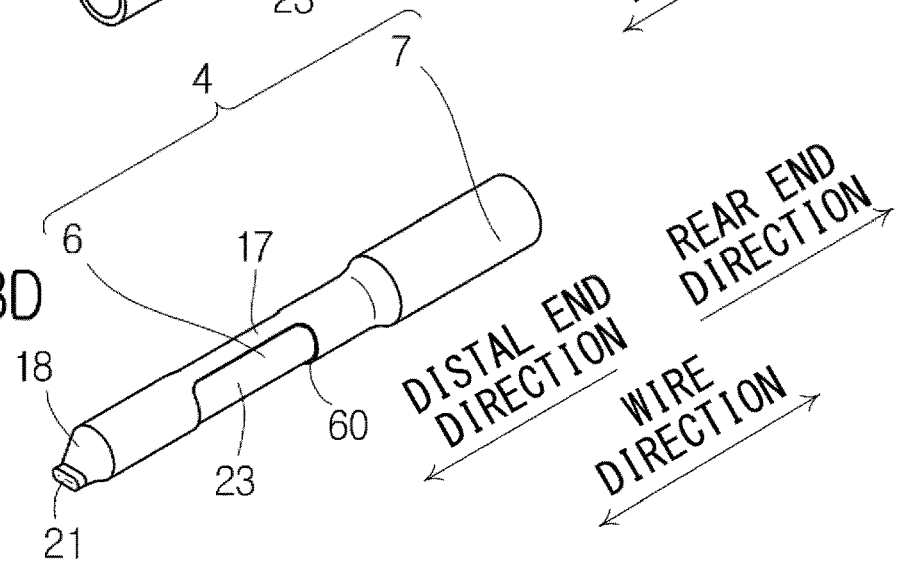
FIG. 23D is a view illustrating each step of the manufacturing method for a wire with a terminal (second embodiment).

Next, as shown in FIG. 23C, the insulation coating 7 is cut at a position toward the rear end direction relative to the distal end surface 11 of the core wire 6, and thereby the core wire exposure hole 60 is made in the insulation coating 7. To be specific, the core wire exposure hole 60 is made in a part that has become thinner than before stretching as a result of having been stretched in the stretching step (S200). The coating joint part 17 is thereby formed, and the core wire exposure part 23 is also made.

Step S220: Sealing Step

Then, as shown in FIG. 23D, the coating extension part 18 is crushed in the vertical direction, and the crushed part is closed by welding, and thereby the welded part 21 is formed in the coating extension part 18. The distal end surface 11 is thereby sealed.

Step S230: Crimping Step

After that, the terminal 5 is crimped onto the wire 4. The wire with terminal 3 is thereby produced.

In this manner, the stretching step and the exposing step may be interchanged.

In this embodiment, as described above, the exposing step is performed after the stretching step, and, in the exposing step (S210), the core wire exposure hole 60 is made in a part that has become thinner than before stretching as a result of having been stretched in the stretching step (S200). This method is capable of making the coating joint part 17 thin in a simple process.

Third Embodiment

Figure 24:
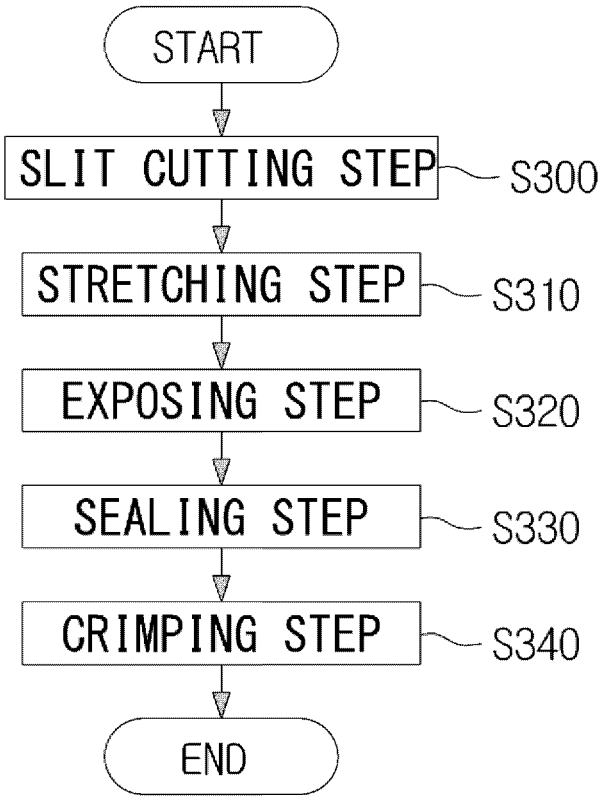
FIG. 24 is a flowchart of a manufacturing method for a wire with a terminal (third embodiment).

A third embodiment is described hereinafter with reference to FIGS. 24 to 25D. Hereinafter, differences from the above-described first embodiment are mainly described, and redundant description is omitted. FIG. 24 is a flowchart of a manufacturing method for the wire with terminal 3. FIGS. 25A to 25D are views illustrating each step of the manufacturing method for the wire with terminal 3.

This embodiment is different from the above-described first embodiment in the manufacturing method for the wire with terminal 3.

Specifically, in the above-described first embodiment, as shown in FIG. 19, the exposing step (S100) is performed first, and the stretching step (S110) is performed after that. On the other hand, this embodiment is as follows.

Step S300: Slit Cutting Step

Figure 25A:
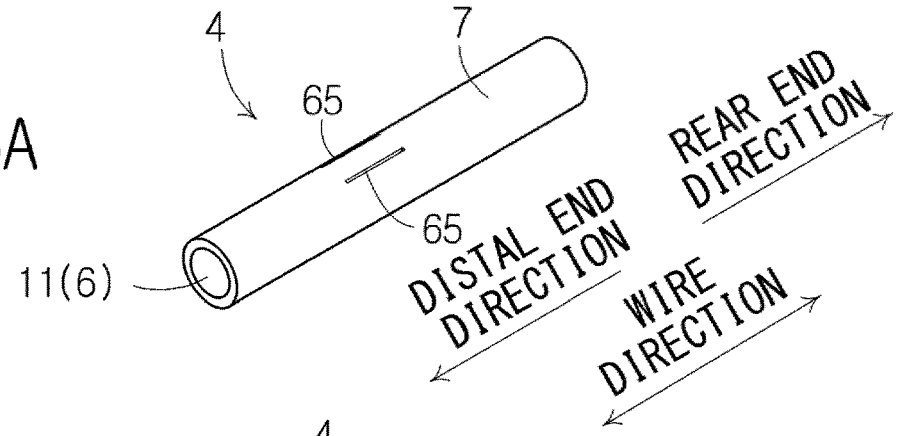
FIG. 25A is a view illustrating each step of the manufacturing method for a wire with a terminal (third embodiment).

First, as shown in FIG. 25A, two first slits 65 that extend in the wire direction and separate from each other in the circumferential direction are cut in the insulation coating 7 that covers the core wire 6. The two first slits 65 are cut at the positions away from the distal end surface 11 in the wire direction. The two first slits 65 can be cut with a cutting tool, for example.

Step S310: Stretching Step

Figure 25B:
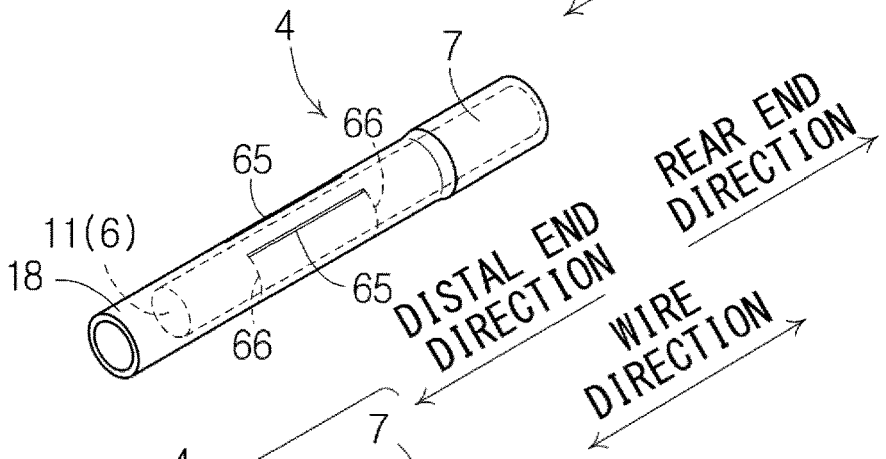
FIG. 25B is a view illustrating each step of the manufacturing method for a wire with a terminal (third embodiment).

Next, as shown in FIG. 25B, the insulation coating 7 is stretched in the distal end direction in such a way that the insulation coating 7 extends beyond the distal end surface 11. To be specific, the insulation coating 7 is stretched in such a way that the length of the two first slits 65 cut in the slit cutting step (S300) in the wire direction is elongated. As a result, the coating extension part 18, which is a part of the insulation coating 7 extending beyond the distal end surface 11, is formed.

Step S320: Exposing Step

Figure 25C:
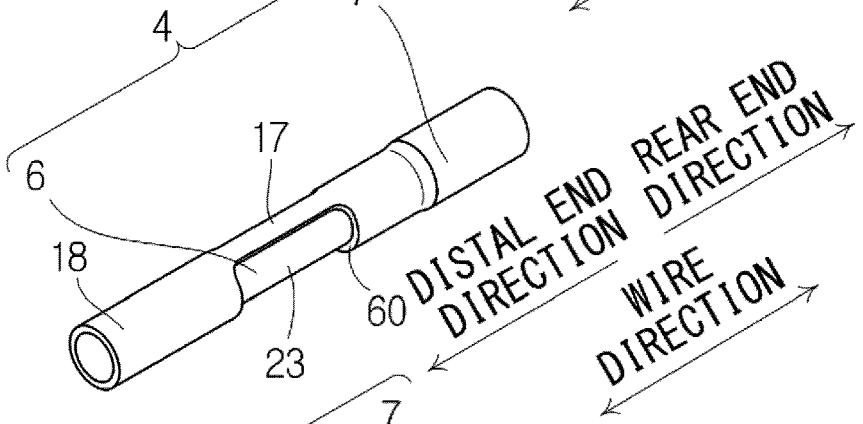
FIG. 25C is a view illustrating each step of the manufacturing method for a wire with a terminal (third embodiment).
Figure 25D:
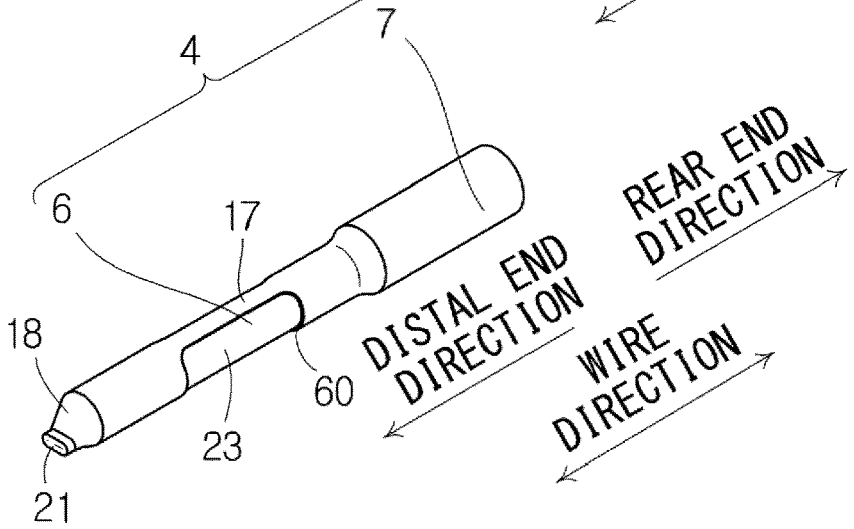
FIG. 25D is a view illustrating each step of the manufacturing method for a wire with a terminal (third embodiment).

Next, as shown in FIGS. 25B and 25C, two second slits 66 are cut to connect the corresponding ends of the two first slits 65, and thereby the core wire exposure hole 60 is made in the insulation coating 7. The coating joint part 17 is thereby formed, and the core wire exposure part 23 is also made.

Step S330: Sealing Step

Then, as shown in FIG. 25D, the coating extension part 18 is crushed in the vertical direction, and the crushed part is closed by welding, and thereby the welded part 21 is formed in the coating extension part 18. The distal end surface 11 is thereby sealed.

Step S340: Crimping Step

After that, the terminal 5 is crimped onto the wire 4. The wire with terminal 3 is thereby produced.

The above-described third embodiment has the following features.

As shown in FIGS. 25A, the manufacturing method for the wire 4 further includes the slit cutting step (S300) of cutting, in the insulation coating 7 of the wire 4, the two first slits 65 extending in the longitudinal direction of the core wire 6 and separating from each other in the circumferential direction. As shown in FIG. 24, the stretching step (S310) is performed after the slit cutting step (S300). The exposing step (S320) is performed after the stretching step (S310). In the stretching step (S310), the insulation coating 7 is stretched in such a way that the length of the two first slits 65 cut in the slit cutting step (S300) in the wire direction is elongated. In the exposing step (S320), the two second slits 66 are cut to connect the corresponding ends of the two first slits 65, and thereby the core wire exposure hole 60 is made in the insulation coating 7. This method is capable of making the coating joint part 17 thin in a simple process. Further, this method is capable of making the core wire exposure hole 60 in two separate steps.

It should be noted that, the method may cut three or more first slits 65 instead of cutting the two first slits 65. Likewise, the method may cut three or more second slits 66 instead of cutting the two second slits 66.

Fourth Embodiment

Figure 26:
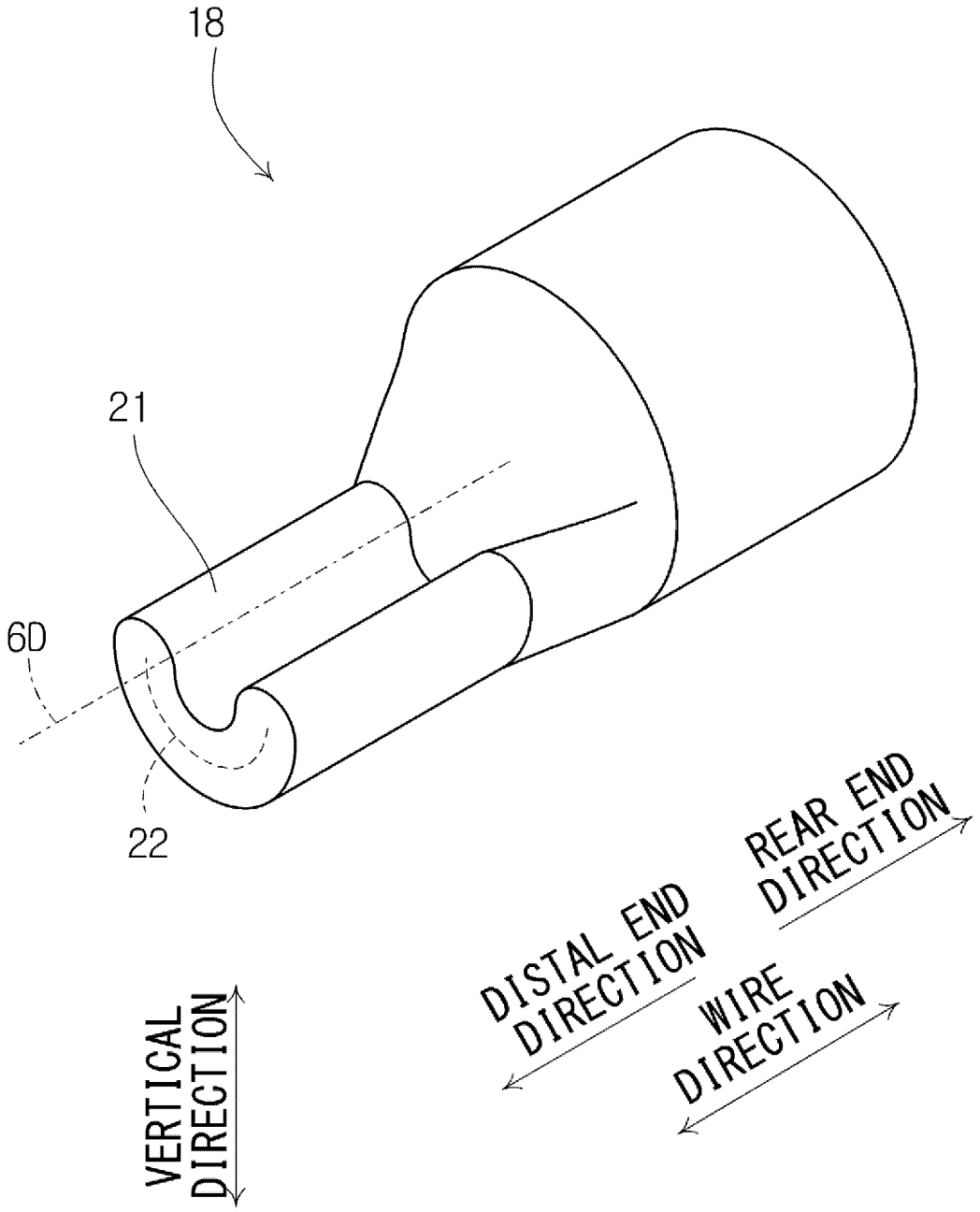
FIG. 26 is an enlarged perspective view of a welded part (fourth embodiment).

A fourth embodiment is described hereinafter with reference to FIG. 26. Hereinafter, differences from the above-described first embodiment are mainly described, and redundant description is omitted. FIG. 26 is an enlarged perspective view of the coating extension part 18.

In the above-described first embodiment, the cross-sectional shape of the welded part 21 is a track shape as shown in FIG. 6. In this embodiment, on the other hand, as shown in FIG. 26, the cross-sectional shape of the welded part 21 is a U-shape that is convex outward in the radial direction. Further, the welded part 21 is formed to avoid the virtual extension line 6D. Note that the cross-sectional shape of the welded part 21 may be a V-shape or an ellipse instead of a U-shape.

Fifth Embodiment

Figure 27:
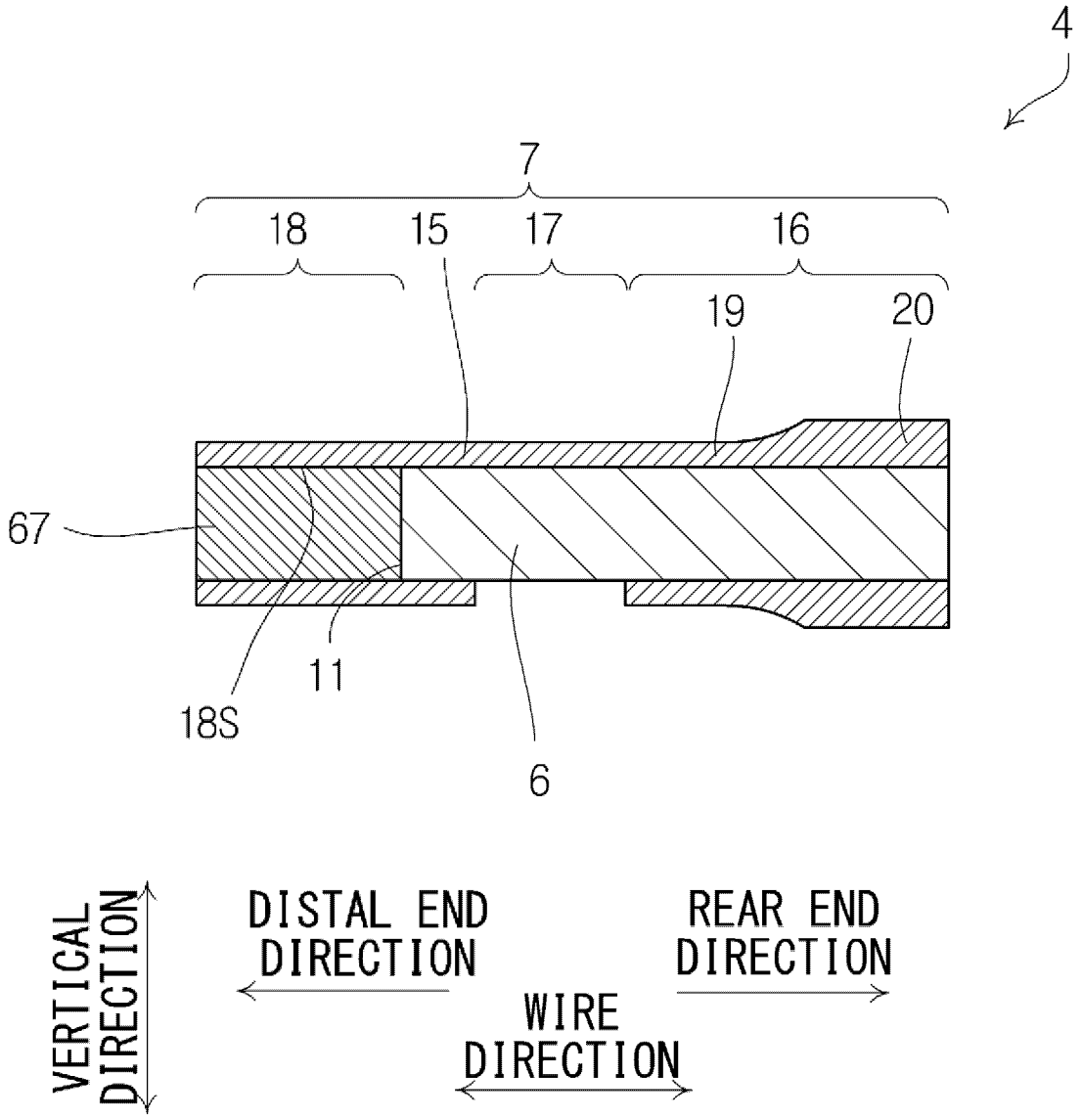
FIG. 27 is a partial front cross-sectional view of a wire (fifth embodiment).

A fifth embodiment is described hereinafter with reference to FIG. 27. Hereinafter, differences from the above-described first embodiment are mainly described, and redundant description is omitted. FIG. 27 is a partial front cross-sectional view of the wire 4.

In the above-described first embodiment, as shown in FIG. 4, the distal end surface 11 of the core wire 6 is sealed by forming the welded part 21 in the coating extension part 18.

On the other hand, in this embodiment, as shown in FIG. 27, the distal end surface 11 of the core wire 6 is sealed by filling an internal space 18S of the coating extension part 18 with the sealing material 67. The sealing material 67 may be an adhesive or a water repellant. Compared with the case of simply applying the sealing material 67 onto the distal end surface 11 of the core wire 6, filling the internal space 18S of the coating extension part 18 with the sealing material 67 is expected to have a storage effect to maintain the state where the sealing material 67 is in contact with the distal end surface 11 of the core wire 6 without coming off the distal end surface 11 of the core wire 6 due to dripping before the sealing material 67 is hardened. Further, after the sealing material 67 is hardened, this is expected to have an effect of adjusting the position of the coating extension part 18 of the core wire 6 in relation to the terminal 5 as desired at the time of crimping because the outer shape of the hardened sealing material 67 does not vary. Further, since the hardened sealing material 67 is covered with the coating extension part 18, this is also expected to have an effect of preventing the sealing material 67 from coming off the wire 4.

Further, the distal end surface 11 of the core wire 6 may be sealed by inserting a hard or soft sealing member into the internal space 18S of the coating extension part 18 instead of filling the internal space 18S of the coating extension part 18 with the sealing material 67. The hard sealing member may be acrylic resin or polystyrene, for example. The soft sealing member may be polyethylene or polypropylene, for example. Compared with the case of applying or disposing the sealing material 67 onto the distal end surface 11 of the core wire 6, inserting the sealing member into the internal space 18S of the coating extension part 18 is expected to have an effect of stabilizing the position of the coating extension part 18 of the core wire 6 with respect to the terminal 5 at the time of crimping.

Sixth Embodiment

Figure 28:
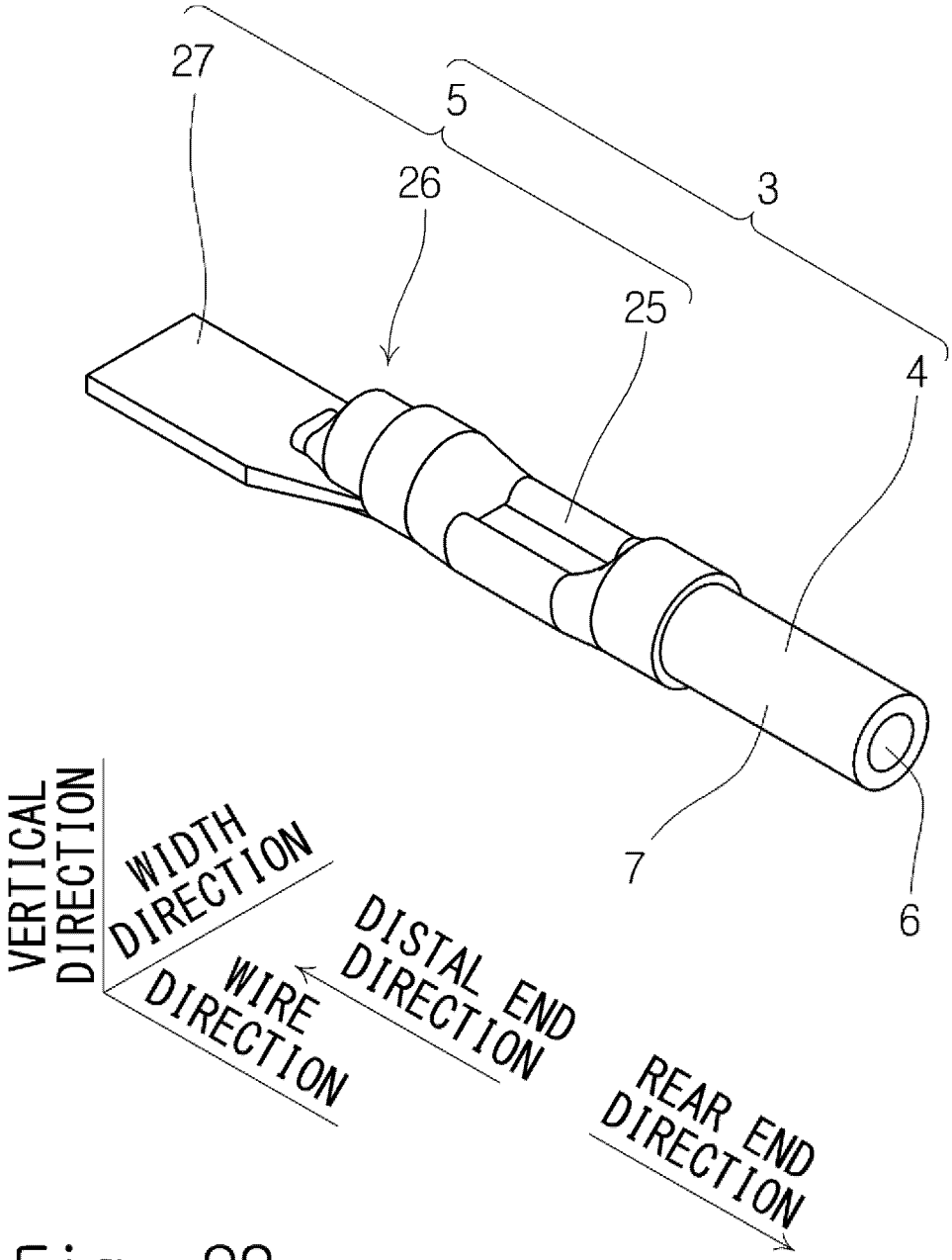
FIG. 28 is a partial perspective view of a wire with a terminal (sixth embodiment).

A sixth embodiment is described hereinafter with reference to FIG. 28. Hereinafter, differences from the above-described first embodiment are mainly described, and redundant description is omitted. FIG. 28 is a partial perspective view of the wire with terminal. In FIG. 28, the electrical contact part 27 is shown in a simplified way.

In the above-described first embodiment, the wire crimp part 25 of the terminal 5 is formed in an open barrel shape as shown in FIG. 10.

On the other hand, in this embodiment, the wire crimp part 25 of the terminal 5 is formed in a tubular closed barrel shape as shown in FIG. 28. Then, the wire crimp part 25 is crimped onto the distal end coating part 15, the core wire exposure part 23 (the second distal end region 13) and the insulation coating body 16 just like in the first embodiment, and thereby the core wire exposure part 23 (the second distal end region 13) is sealed.

The first to sixth embodiments are described above. The above-described first to sixth embodiments may be implemented in any combination.

Each of the above-described embodiments may be varied as follows, for example.

Modified Example 1

Figure 29:
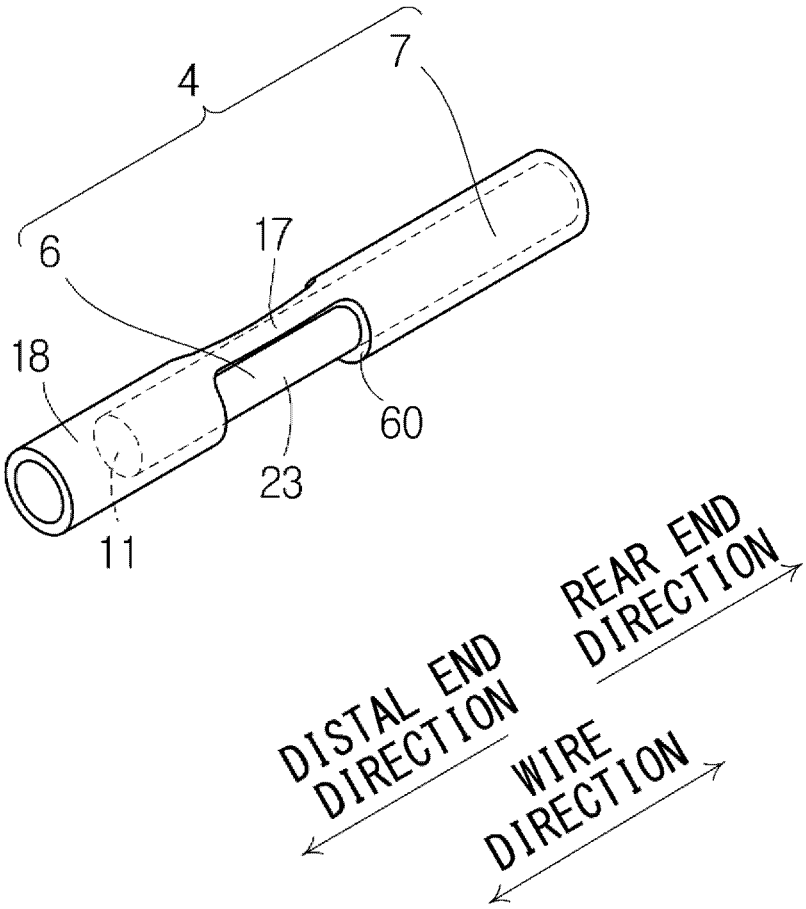
FIG. 29 is a perspective view of a wire in which only a coating joint part is thin (first modified example).

A modified example of the first to sixth embodiments is described hereinbelow as a modified example 1 with reference to FIG. 29. Hereinafter, differences of this modified example from each of the above-described embodiments are mainly described, and redundant description is omitted. For example, in FIG. 5, the thickness 15T of the distal end coating part 15, the thickness 17T of the coating joint part 17, the thickness 19T of the first body part 19, and the thickness 20T of the second body part 20 satisfy the relationship of 15T=17T=19T<20T. Alternatively, they may satisfy the relationship of 17T<15T=19T=20T. Specifically, in the stretching step (S110) of FIG. 19, only the coating joint part 17 of the insulation coating 7 may be stretched in the wire direction as shown in FIG. 29. In this case, only the coating joint part 17 is thin compared with the other parts of the insulation coating 7.

Modified Example 2

A modified example of the first to fourth embodiments and the sixth embodiment is described hereinbelow as a modified example 2 with reference to FIGS. 30 and 31. Hereinafter, differences of this modified example from each of the above-described embodiments are mainly described, and redundant description is omitted.

For example, in the above-described first embodiment, as shown in FIGS. 19, 20B and 20C, the welded part 21 is first formed in the coating extension part 18 and the distal end surface 11 of the core wire 6 is thereby sealed (S120) by crushing the coating extension part 18 in the vertical direction and then closing the crushed part by welding, and then the terminal 4 is crimped onto the wire 5 (S130). In this case, there is a possibility that when the terminal 4 is crimped onto the wire 5, the insulation coating 7 is pushed out beyond the wire crimp part 25 in the distal end direction and bulges upward, and thereby the retainer insertion space 47 of the wire with terminal 3 shown in FIG. 18 disappears, which makes it unable to pull the retainer 52 down to a specified locking position.

Figure 30:
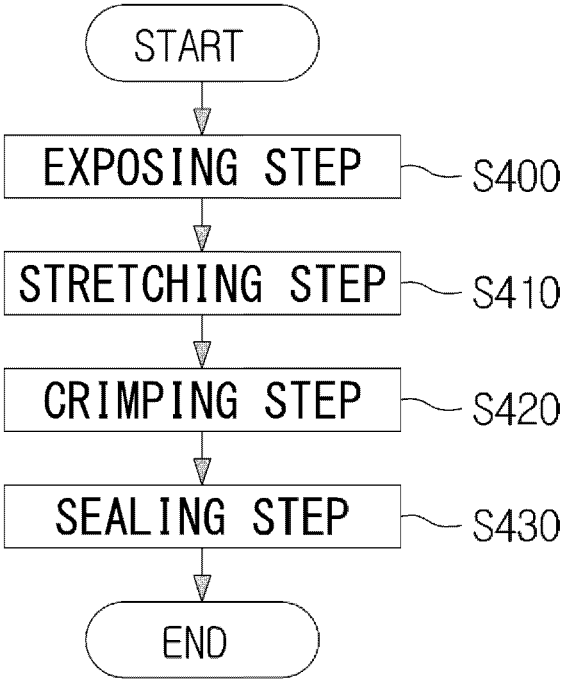
FIG. 30 is a flowchart of a manufacturing method for a wire with a terminal (second modified example).

On the other hand, in this modified example, as shown in FIG. 30, the terminal 4 is first crimped onto the wire 5 (crimping step: S420), and then the welded part 21 is formed in the coating extension part 18 and the distal end surface 11 of the core wire 6 is thereby sealed (sealing step: S430) by crushing the coating extension part 18 in the vertical direction and then closing the crushed part by welding. In this manner, by performing the sealing step (S430) after the crimping step (S420), even if the insulation coating 7 is pushed out beyond the wire crimp part 25 in the distal end direction and bulges upward, because the welded part 21 is formed in the subsequent sealing step (S430), the bulging part disappears, and therefore the retainer insertion space 47 of the wire with terminal 3 shown in FIG. 18 is left with no problem, and the retainer 52 is reliably pulled down to a specified locking position. Note that an exposing step (S400) and a stretching step (S410) are respectively the same as the exposing step (S100) and the stretching step (S110) in FIG. 19 and therefore not redundantly described. Note that, as described earlier, the exposing step (S400) and the stretching step (S410) may be interchanged.

Figure 31:
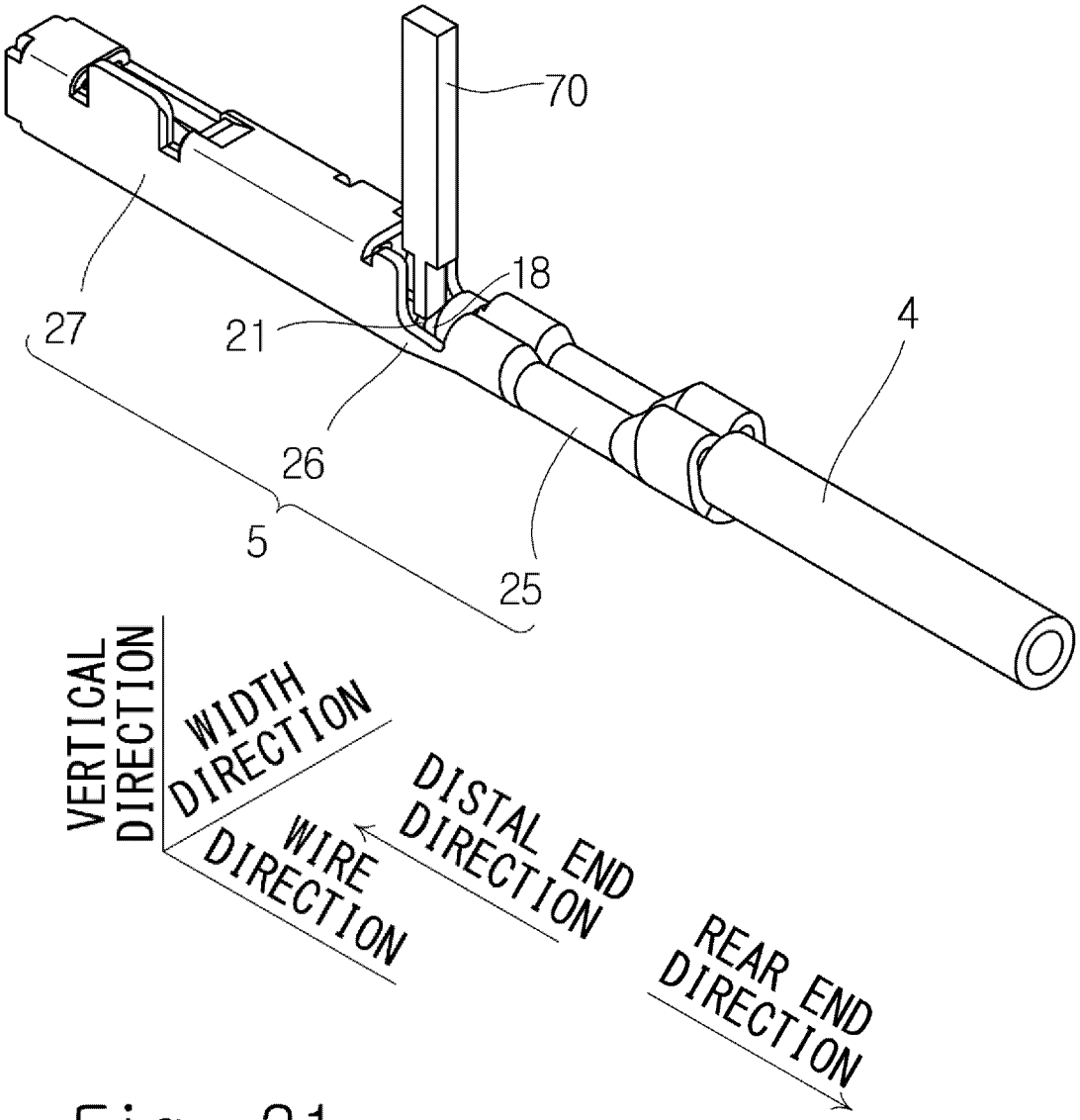
FIG. 31 is a view showing the way a wire is sealed by welding after a terminal is crimped onto the wire (second modified example).
Figure 32:
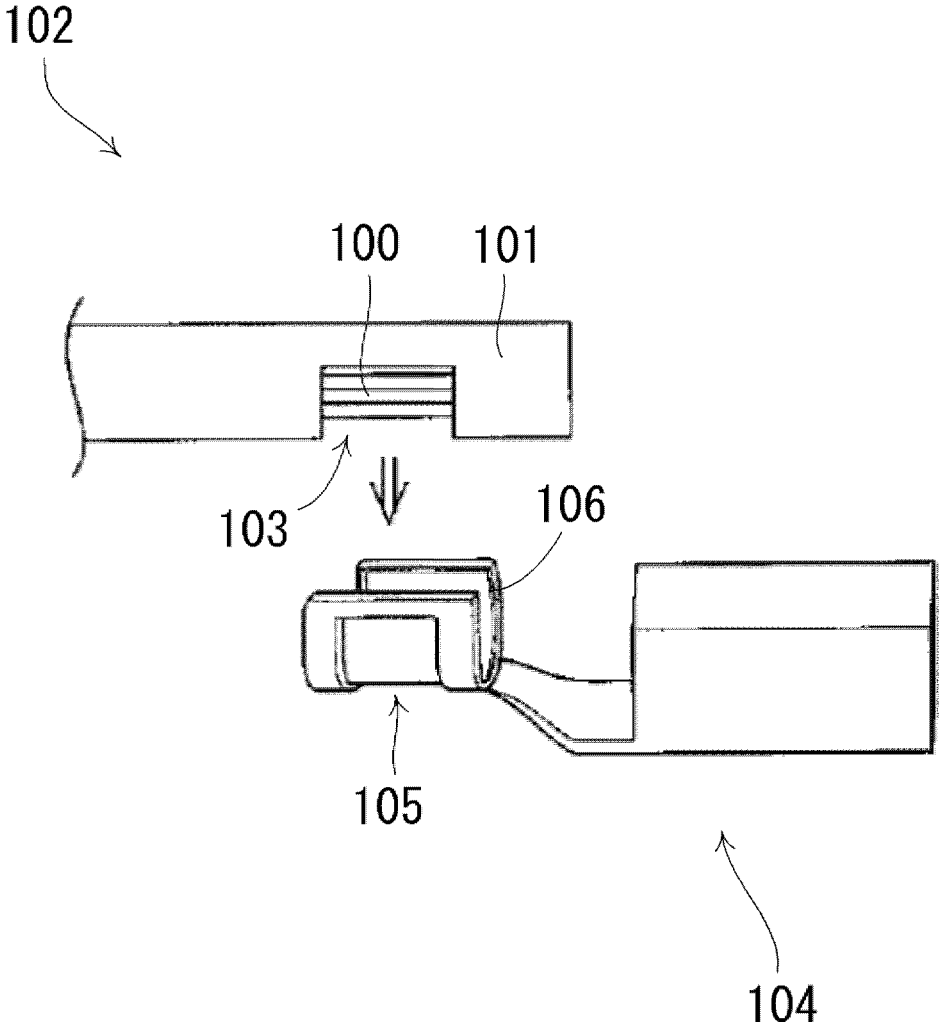
FIG. 32 is a view showing, in a simplified manner, FIG. 9 of Patent Literature 1.

FIG. 31 is a view showing the way the welded part 21 is formed in the coating extension part 18 after the terminal 4 is crimped onto the wire 5. As shown in FIG. 31, since the coating extension part 18 is not covered with the terminal 5 even after crimping, and therefore the welded part 21 is able to be formed in the coating extension part 18 after crimping by using a welding tool 70. The welding tool 70 is made to form the welded part 21 in the coating extension part 18 by using heat or ultrasonic waves, for example.

The second modified example is described above with reference to FIGS. 30 and 31. The above-described second modified example has the following features.

Specifically, the manufacturing method for the wire with terminal 3 that manufactures the wire with terminal 3 by attaching the terminal 5 to the wire 4 that includes the core wire 6 and the insulation coating 7 covering the core wire 6 as shown in FIGS. 2 and 3 includes the exposing step (S400), the stretching step (S410), the crimping step (S420) and the sealing step (S430) as shown in FIG. 30.

In the exposing step (S400), at least part of the core wire 6 is exposed by making the core wire exposure hole 60 (hole) in the insulation coating 7 as shown in FIG. 20A, for example.

In the stretching step (S410), the insulation coating 7 is stretched in such a way that the insulation coating 7 extends beyond the distal end surface 11 of the core wire 6 as shown in FIG. 20B, for example.

In the crimping step (S420), the crimp piece 29 of the terminal 5 is crimped onto the wire 4 so as to seal the core wire exposure part 23 where the core wire 6 is exposed as shown in FIGS. 10 to 12, for example.

The sealing step (S430) is performed after the crimping step (S420). In the sealing step (S430), the distal end surface 11 of the core wire 6 is sealed by welding the coating extension part 18, which is a part of the insulation coating 7 extending beyond the distal end surface 11 of the core wire 6, as shown in FIG. 31, for example.

According to the above-described manufacturing method, the welded part 21 is formed after crimping, and therefore the retainer insertion space 47 is reliably left above the welded part 21. This allows the retainer 52 to be reliably pulled down to a specified locking position.

This application is based upon and claims the benefit of priority from Japanese patent application No. 2018-037952 filed on Mar. 2, 2018, the disclosure of which is incorporated herein in its entirety by reference.

The invention claimed is:

1. A wire comprising:

a core wire; and an insulation coating that covers an outer periphery of the core wire, wherein the core wire includes a distal end region containing a distal end surface of the core wire, and a body region being a part other than the distal end region, the distal end region includes a first distal end region containing the distal end surface, and a second distal end region located between the first distal end region and the body region, and the insulation coating includes a distal end coating part that covers an outer periphery of the first distal end region in a tube shape, an insulation coating body that covers an outer periphery of the body region in a tube shape, at least one coating joint part that joins the distal end coating part and the insulation coating body together in such a way that at least part of an outer periphery of the second distal end region is exposed, and a coating extension part that extends from the distal end coating part beyond the distal end surface in a tube shape, the distal end coating part, the insulation coating body, the at least one coating joint part and the coating extension part are integrally formed.

2. The wire according to claim 1, wherein a thickness of the coating joint part in a radial direction, the thickness of the coating joint part being a distance from an inner peripheral surface of the coating joint part to an outer peripheral surface thereof, is smaller than a maximum thickness of the insulation coating body in the radial direction, the maximum thickness of the insulation coating body being a maximum distance from an inner peripheral surface of the insulation coating body to an outer peripheral surface thereof.

3. The wire according to claim 2, wherein the insulation coating body includes a first body part touching the coating joint part, and a second body part located farther from the distal end surface than the first body part is, a thickness of the first body part in the radial direction is the same as the thickness of the coating joint part in the radial direction, and a thickness of the second body part in the radial direction is greater than the thickness of the first body part in the radial direction.

4. The wire according to claim 1, wherein a welded part that has been crushed in a cross direction crossing a longitudinal direction of the wire and closed by welding is formed in the coating extension part.

5. The wire according to claim 4, wherein when viewing in the longitudinal direction of the wire, a center of gravity of a cross-section of the welded part orthogonal to the longitudinal direction of the wire and a center of gravity of a cross-section of the distal end coating part orthogonal to the longitudinal direction of the wire do not coincide.

6. The wire according to claim 5, wherein the welded part is formed to avoid a virtual extension line of a central axis of the core wire.

7. The wire according to claim 4, wherein a cross-sectional shape of the welded part orthogonal to the longitudinal direction of the wire is a track shape, an ellipse, a U-shape, or a V-shape.

8. The wire according to claim 4, wherein the cross direction is a direction orthogonal to the longitudinal direction of the wire.

9. A wire with a terminal comprising:

the wire according to claim 4; and a terminal attached to the wire, wherein the terminal includes an electrical contact part capable of coming into electrical contact with a mating terminal, a wire crimp part to be crimped onto the wire, and a terminal joint part that joins the electrical contact part and the wire crimp part together, and the wire crimp part includes two crimp pieces, and each of the crimp pieces is crimped onto the distal end coating part, the second distal end region, and the insulation coating body, and thereby the second distal end region is sealed, or the wire crimp part is formed in a tube shape and crimped onto the distal end coating part, the second distal end region, and the insulation coating body, and thereby the second distal end region is sealed.

10. The wire with the terminal according to claim 9, wherein when viewing the wire crimp part from the electrical contact part in the longitudinal direction of the wire, a center of gravity of a cross-section of the welded part orthogonal to the longitudinal direction of the wire is located between a center of gravity of a cross-section of the distal end coating part orthogonal to the longitudinal direction of the wire and the terminal joint part.

11. The wire according to claim 1, wherein an internal space of the coating extension part is filled with a sealing material, or a sealing member is inserted into the internal space of the coating extension part.

12. A wire with a terminal comprising:

the wire according to claim 11; and a terminal attached to the wire, wherein the terminal includes an electrical contact part capable of coming into electrical contact with a mating terminal, a wire crimp part to be crimped onto the wire, and a terminal joint part that joins the electrical contact part and the wire crimp part together, and the wire crimp part includes two crimp pieces, and each of the crimp pieces is crimped onto the distal end coating part, the second distal end region, and the insulation coating body, and thereby the second distal end region is sealed, or the wire crimp part is formed in a tube shape and crimped onto the distal end coating part, the second distal end region, and the insulation coating body, and thereby the second distal end region is sealed.

13. A manufacturing method for a wire, comprising:

an exposing step of exposing at least part of a core wire by making a hole in an insulation coating that covers the core wire; and a stretching step of stretching the insulation coating in such a way that the insulation coating extends beyond a distal end surface of the core wire.

14. The manufacturing method according to claim 13, wherein the stretching step is performed after the exposing step, and in the stretching step, the insulation coating is stretched in such a way that the hole made in the exposing step is enlarged.

15. The manufacturing method according to claim 13, wherein the exposing step is performed after the stretching step, and in the exposing step, the hole is made in a part having become thinner than before stretching as a result of having been stretched in the stretching step.

16. The manufacturing method according to claim 13, further comprising:

a slit cutting step of cutting, in the insulation coating, at least two first slits extending in the longitudinal direction of the core wire and separating from each other in a circumferential direction, wherein the stretching step is performed after the slit cutting step, the exposing step is performed after the stretching step, in the stretching step, the insulation coating is stretched in such a way that the at least two first slits cut in the slit cutting step are elongated, and in the exposing step, at least two second slits are cut to connect corresponding ends of the at least two first slits, and thereby the hole is made in the insulation coating.

17. The manufacturing method according to claim 13, further comprising:

a step of crushing a part of the insulation coating extending beyond the distal end surface of the core wire in a cross direction crossing a longitudinal direction of the core wire; and a step of closing the crushed part by welding.

18. The manufacturing method according to claim 13, further comprising:

a step of filling a sealing material or inserting a sealing member into an internal space of a part of the insulation coating extending beyond the distal end surface of the core wire.

19. A manufacturing method for a wire with a terminal, the method manufacturing the wire with the terminal by attaching the terminal to the wire including a core wire and an insulation coating that covers the core wire, comprising:

an exposing step of exposing at least part of the core wire by making a hole in the insulation coating;

a stretching step of stretching the insulation coating in such a way that the insulation coating extends beyond a distal end surface of the core wire;

a crimping step of crimping a crimp piece of the terminal onto the wire so as to seal a part where the core wire is exposed; and a sealing step of sealing the distal end surface of the core wire by welding a part of the insulation coating extending beyond the distal end surface of the core wire after the crimping step.

* * * * *